US010388449B2

(12) United States Patent
Park et al.

(10) Patent No.: US 10,388,449 B2
(45) Date of Patent: Aug. 20, 2019

(54) TRANSFORMER AND PLATE COIL MOLDED BODY

(71) Applicant: SOLUM CO., LTD., Suwon-si (KR)

(72) Inventors: Geun-young Park, Suwon-si (KR); Bong-ho Jang, Suwon-si (KR); Jae-gen Eom, Suwon-si (KR); Young-seung Noh, Suwon-si (KR); Heung-gyoon Choi, Suwon-si (KR); Heui-wook Kim, Suwon-si (KR)

(73) Assignee: SOLUM CO., LTD., Suwon-si (KR)

( * ) Notice: Subject to any disclaimer, the term of this patent is extended or adjusted under 35 U.S.C. 154(b) by 78 days.

(21) Appl. No.: 15/168,331

(22) Filed: May 31, 2016

(65) Prior Publication Data

US 2017/0032888 A1 Feb. 2, 2017

(30) Foreign Application Priority Data

Jul. 31, 2015 (KR) ..... 10-2015-0109156
Sep. 4, 2015 (KR) ..... 10-2015-0125713

(51) Int. Cl.
*H01F 27/32* (2006.01)
*H01F 27/24* (2006.01)
*H01F 27/28* (2006.01)

(52) U.S. Cl.
CPC ..... *H01F 27/2804* (2013.01); *H01F 27/2823* (2013.01); *H01F 27/2847* (2013.01); *H01F 27/325* (2013.01); *H01F 2027/2819* (2013.01)

(58) Field of Classification Search
CPC ..... H01F 27/32; H01F 27/24; H01F 27/28; H01F 27/2804; H01F 27/2823;
(Continued)

(56) References Cited

U.S. PATENT DOCUMENTS 2,010,314 A * 8/1935 Millar, Jr. ..... B24B 23/06 118/257
5,010,314 A 4/1991 Estrov
(Continued)

FOREIGN PATENT DOCUMENTS

CN 102412057 A 4/2012
JP 2008108936 A 5/2008
(Continued)

OTHER PUBLICATIONS

Communication dated Apr. 2, 2019 issued by the State Intellectual Property Office of P.R. China in counterpart Chinese Application No. 201610443979.9.

*Primary Examiner* — Mang Tin Bik Lian
(74) *Attorney, Agent, or Firm* — Sughrue Mion, PLLC

(57) ABSTRACT

A transformer is provided, which includes a magnetic core, a primary coil module including a coil support arranged in the magnetic core and a primary coil formed on the coil support, an upper secondary coil module including an upper insulation molded body arranged on an upper portion of the primary coil module and an upper plate coil buried in the upper insulation molded body and arranged to face the primary coil, and a lower secondary coil module including a lower insulation molded body arranged on a lower portion of the primary coil module and a lower plate coil buried in the lower insulation molded body and arranged to face the primary coil.

26 Claims, 33 Drawing Sheets

(58) Field of Classification Search
CPC .... H01F 27/2847; H01F 27/325; H01F 41/12; H01F 2027/2819; H01F 5/04; H01F 5/06; H01F 2005/043
USPC ..... 336/212, 232, 170, 220–221, 192, 147
See application file for complete search history.

(56) References Cited

U.S. PATENT DOCUMENTS

| | | | | |
|---|---|---|---|---|
| 5,559,487 | A * | 9/1996 | Butcher | H01F 27/324 336/178 |
| 7,460,002 | B2 * | 12/2008 | Estrov | H01F 27/2804 336/182 |
| 7,884,692 | B2 * | 2/2011 | Yen | H01F 27/06 336/192 |
| 8,502,633 | B2 | 8/2013 | Park et al. | |
| 8,648,687 | B2 | 2/2014 | Li et al. | |
| 2011/0241816 | A1 | 10/2011 | Park et al. | |
| 2012/0154095 | A1 * | 6/2012 | Li | H01F 27/06 336/199 |
| 2014/0028433 | A1 * | 1/2014 | Kim | H01F 30/06 336/84 R |
| 2014/0327511 | A1 * | 11/2014 | Tsai | H01F 27/28 336/220 |
| 2016/0086718 | A1 * | 3/2016 | Tsai | H01F 27/266 336/192 |

FOREIGN PATENT DOCUMENTS

| | | | |
|---|---|---|---|
| JP | 2011192724 | A | 9/2011 |
| KR | 1020110051430 | A | 5/2011 |
| KR | 1020110111778 | A | 10/2011 |

* cited by examiner

TRANSFORMER AND PLATE COIL MOLDED BODY

CROSS-REFERENCE TO RELATED APPLICATIONS

This application claims priority from Korean Patent Application Nos. 10-2015-0109156 and 10-2015-0125713 filed on Jul. 31, 2015 and Sep. 4, 2015, respectively, in the Korean Intellectual Property Office, the disclosure of which is incorporated herein by reference in its entirety.

BACKGROUND OF THE INVENTION

Field of the Invention

The present disclosure relates to a transformer provided in a power supply device or the like.

Description of the Related Art

A power unit is provided in a power supply device. A transformer provided in the power unit has a size that is about ⅓ of the overall size of the power unit. The transformer has a small number of components including a core, a bobbin, and coils. However, since a primary coil and a secondary coil provided in the transformer should be insulated from each other in order to secure a space for an insulation distance that is required between the coils and to satisfy the safety standards, a process for manufacturing the transformer is complicated.

Further, in the case of winding a coil, the number of turns and/or winding position of the coil may not be constant depending on each worker. Accordingly, there is a need for schemes to develop a transformer having a new structure for miniaturization of the transformer and simplification of the manufacturing process.

SUMMARY OF THE INVENTION

Exemplary embodiments of the present disclosure overcome the above disadvantages and other disadvantages not described above, and provide a transformer, which can achieve miniaturization and improve assemblability and productivity.

Exemplary embodiments of the present disclosure provide a transformer, which can heighten the coupling coefficient between a primary coil module and a secondary coil module and implement uniformity of the coupling coefficient.

Exemplary embodiments of the present disclosure provide a transformer, which can reduce leakage inductance and make it possible to implement and manage uniform leakage inductance.

According to an aspect of the present disclosure, a transformer includes upper and lower secondary coil modules in which upper and lower plate coils are buried in upper and lower insulation molded bodies, respectively, wherein the upper and lower secondary coil modules are arranged on upper and lower sides in a state where a primary coil module is interposed between the upper and lower secondary coil modules in a magnetic core.

According to an aspect of the present disclosure, the primary coil module may include an insulating substrate and a conductor pattern formed as at least one layer on the insulating substrate.

According to another aspect of the present disclosure, the primary coil module may include a bobbin and a wire that is wound on the bobbin.

According to another aspect of the present disclosure, a transformer includes a secondary coil module in which a plate coil is buried in an insulation molded body, wherein upper and lower primary coil modules are arranged on upper and lower sides in a state where the secondary coil module is interposed between the upper and lower primary coil modules in a magnetic core.

According to an aspect of the present disclosure, a plate coil molded body includes at least one plate coil connected to a frame, wherein the plate coil includes a first plate coil member having both end portions connected to the frame and an intermediate region wound in a "U" shape in an accommodation space of the frame, and a second plate coil member having both end portions drawn between the both end portions of the first plate coil member to be connected to the frame and an intermediate region wound in a "U" shape to be spaced apart from an inside of the first plate coil member.

According to another aspect of the present disclosure, the plate coil may have an outer end portion connected to the frame, an inner end portion arranged in parallel to the outer end portion, and an intermediate region wound in a spiral shape from the outer end portion to be connected to the inner end portion in the accommodation space of the frame.

According to another aspect of the present disclosure, the plate coil may have an outer end portion connected to the frame, an inner end portion arranged in parallel to the outer end portion, and an intermediate region wound in a spiral shape from the outer end portion and then bent upward to be connected to the inner end portion in the accommodation space of the frame.

The transformer can heighten the coupling coefficient between the primary coil module and the upper and lower secondary coil modules, and reduce the leakage inductance. The transformer can reduce assembly procedures.

Since the transformer can be miniaturized with reduced height, an air flow for cooling can be formed inside an adaptor in which the transformer is mounted to lower the temperature of the adaptor.

In comparison to a case where the upper and lower secondary coil modules are constructed by wound wires, the transformer can implement uniform coupling coefficient between the primary coil module and the upper and lower secondary coil modules and make it possible to implement and manage uniform leakage inductance. Further, the transformer can reduce manpower and heighten productivity.

Additional and/or other aspects and advantages of the disclosure will be set forth in part in the description which follows and, in part, will be obvious from the description, or may be learned by practice of the disclosure.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
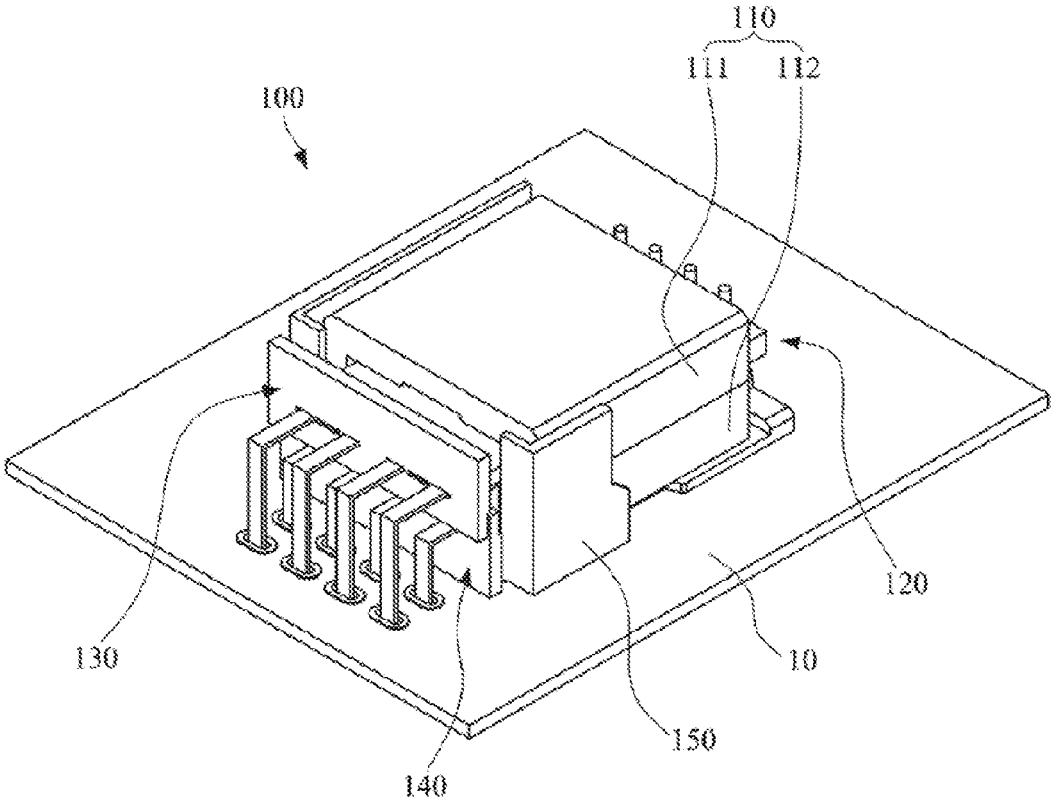
FIG. 1 is a perspective view of a transformer according to a first embodiment of the present disclosure.

Hereinafter, exemplary embodiments of the present disclosure will be described in detail with reference to the accompanying drawings. The following description is provided to assist those of ordinary skill in the art to comprehensively understand the embodiments of the present disclosure. Accordingly, shapes and sizes of some constituent elements illustrated in the drawings may be exaggerated for clarity in explanation.

First Embodiment

Figure 2:
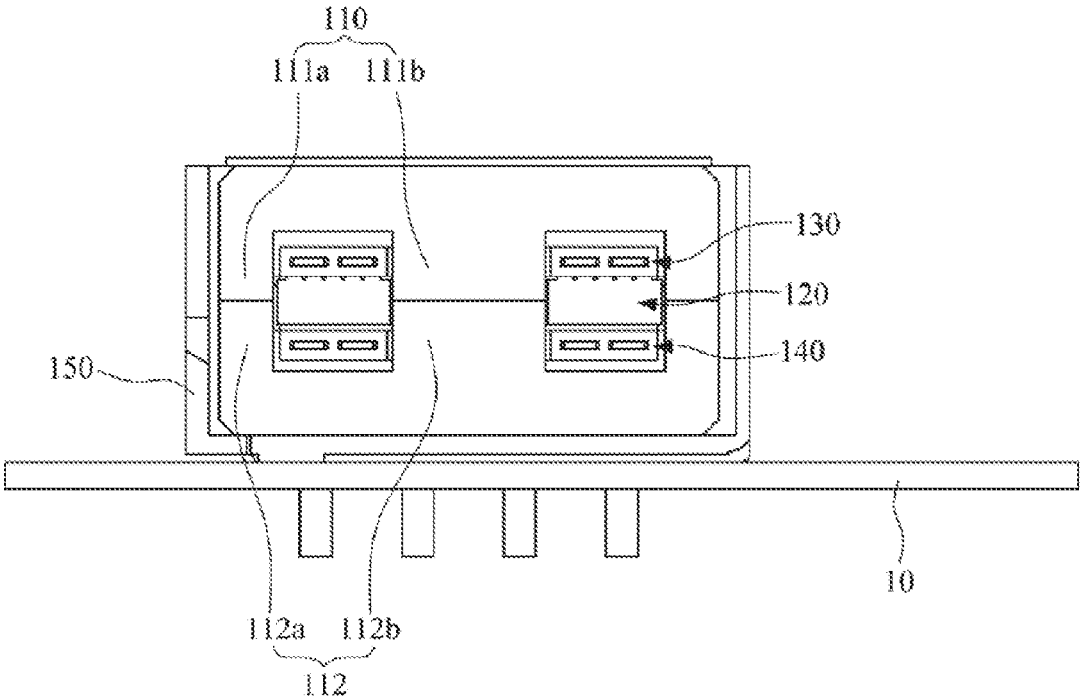
FIG. 2 is a front cross-sectional view of the transformer of FIG. 1.
Figure 3:
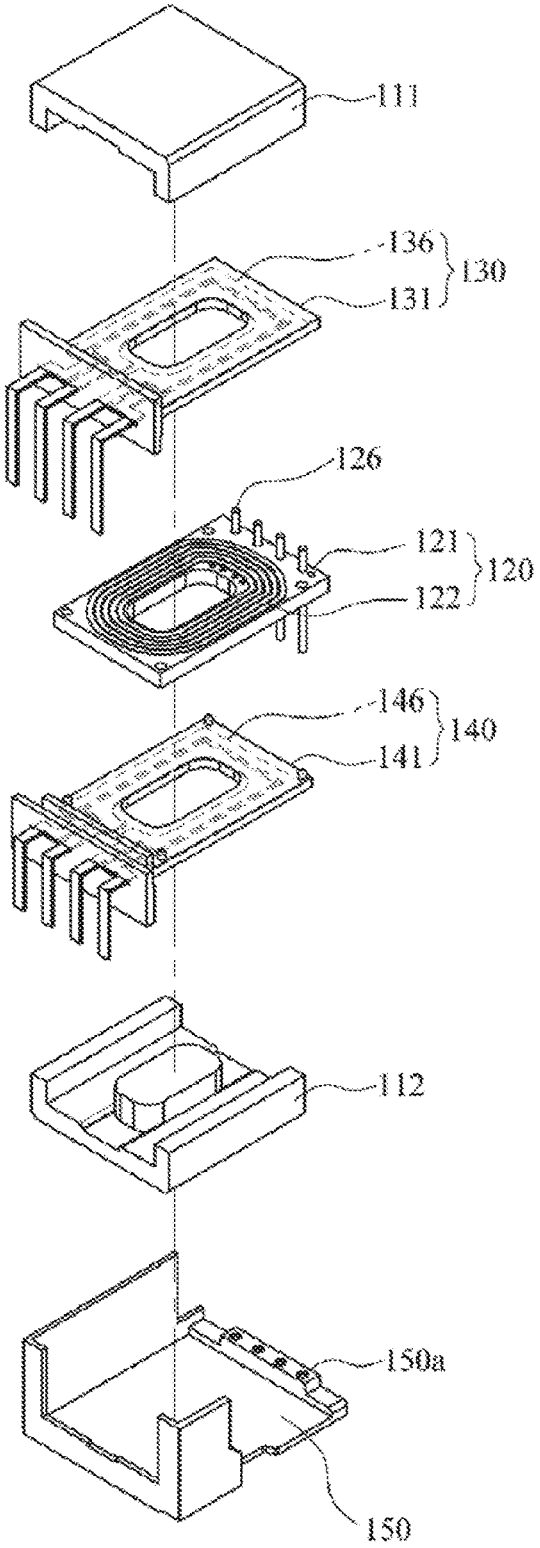
FIG. 3 is an exploded perspective view of the transformer of FIG. 1.
Figure 4:
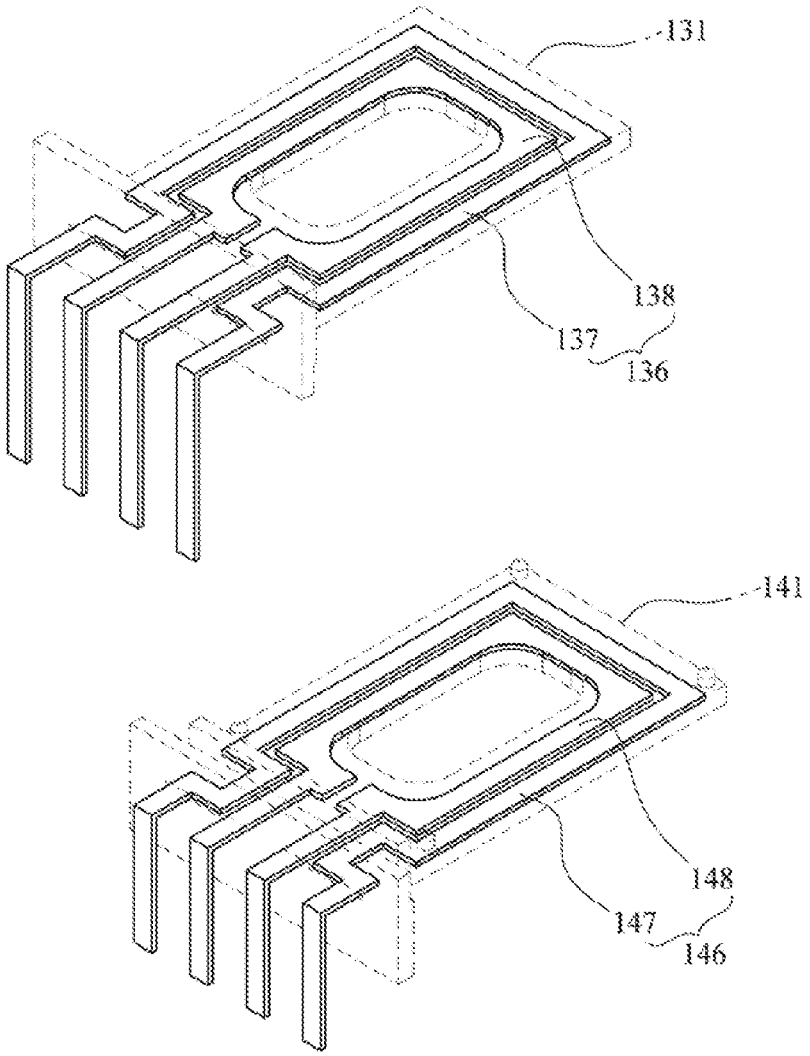
FIG. 4 is a perspective view of upper and lower secondary coil modules extracted from the transformer of FIG. 3.

FIG. 1 is a perspective view of a transformer according to a first embodiment of the present disclosure, and FIG. 2 is a front cross-sectional view of the transformer of FIG. 1. FIG. 3 is an exploded perspective view of the transformer of FIG. 1, and FIG. 4 is a perspective view of upper and lower secondary coil modules extracted from the transformer of FIG. 3.

Referring to FIGS. 1 to 4, a transformer 100 according to a first embodiment of the present disclosure includes a magnetic core 110, a primary coil module 120, an upper secondary coil module 130, and a lower secondary coil module 140.

The magnetic core 110 is formed to have an inner space, and front and rear sides of the magnetic core 110 are formed in an open shape. Here, for convenience in explanation, front and rear directions are defined on the basis of the directions in which the primary coil module 120 and the upper and lower secondary coil modules 130 and 140 are drawn from the inside of the magnetic core 110 to both sides of the magnetic core 110, but are not limited thereto. The definition of upper and lower directions is also for convenience in explanation.

The magnetic core 110 may include an upper core 111 and a lower core 112. The upper core 111 may be formed in a manner that pairs of first legs 111*a* project downward from left and right edges of a lower surface of the upper core 111 and a second leg 111*b* projects downward from the center of the lower surface. That is, the upper core 111 may be formed of an "E"-shaped core having an "E"-shaped cross section.

The lower core 112 may have the same shape as the shape of the upper core 111 to form a pair with the upper core 111. The lower core 111 may be formed of an "E"-shaped core. In this case, the lower core 112 is formed in a manner that pairs of first legs 112*a* project from left and right edges of an upper surface of the lower core 112 to come in contact with the first legs 111*a* of the upper core 111 and a second leg 112*b* projects from the center of the upper surface to come in contact with the second leg 111*b* of the upper core 111.

Without being limited to those as exemplified above, one of the upper and lower cores 111 and 112 may be formed of an "E"-shaped core, and the other thereof may be formed of an "I"-shaped core having an "I"-shaped cross section. As another example, the upper and lower cores 111 and 112 may be formed of "I"-shaped cores.

Between the upper and lower cores 111 and 112, the primary coil module 120, the upper secondary coil module 130, and the lower secondary coil module 140 are arranged. The upper and lower cores 111 and 112 may be wrapped by a tape or the like to be fixed. The upper and lower cores 111 and 112 may be accommodated in a base member 150 in a fixed state, and may be adhered by adhesives in a state where they are accommodated in the base member 150.

The base member 150 is formed to accommodate the magnetic core 110 in the inner space thereof through an upper opening thereof. The base member 150 draws out front and rear regions of the primary coil module 120 and the upper and lower secondary coil modules 130 and 140 through front and rear openings thereof. In the case where outer lead pins 126 are vertically arranged and come in contact with the rear region of the primary coil module 120, pin-fixing holes 150*a* for penetratingly fixing the outer lead pins 126 may be formed at the rear region of the base member 150.

The primary coil module 120 includes a coil support arranged in the magnetic core 110 and a primary coil formed on the coil support. For example, the coil support may be composed of an insulating substrate 121. The primary coil may be composed of a conductor pattern 122 formed as at least one layer on the insulating substrate 121. In this case, the primary coil module 120 may be composed of a multi-layer printed circuit board (MLB).

The MLB has a structure in which a plurality of substrate sheets having the conductor patterns 122 are laminated and the conductor patterns 122 of the laminated substrate sheets are connected to each other through vias. The primary coil module 120 may be formed to have a reduced height.

In the center of the insulating substrate 121, through-holes through which the second legs 111*b* and 112*b* of the upper and lower cores 111 and 112 pass are formed. The insulating substrate 121 may be formed in a rectangular plate shape. The insulating substrate 121 is made of insulating resin. The conductor pattern 122 is connected to the power to receive a primary voltage. The conductor pattern 122 is formed of a conductive metal.

Although not illustrated, the primary coil module 120 may further include an auxiliary coil configured to generate and output an induced voltage through electromagnetic induction with the conductor pattern 122. The auxiliary coil has the same shape as the shape of the conductor pattern 122, and may be formed on at least one substrate sheet to be laminated on the insulating substrate 121.

The induced voltage that is output from the auxiliary coil may be used to drive an IC element or the like that is mounted on an adaptor substrate 10. The conductor pattern 122 of the insulating substrate 121 and the auxiliary coil may be connected to outer lead pins 126. The outer lead pins 126 are connected to the adaptor substrate 10.

The primary coil module 120 may be arranged on an upper side of the upper secondary coil module 130 or on a lower side of the lower secondary coil module 140, but is not limited thereto. This may also be the same in the following embodiments.

The upper secondary coil module 130 includes an upper insulation molded body 131 and an upper plate coil 136. The upper insulation molded body 131 is arranged in the magnetic core 110 to come in contact with the upper side of the insulating substrate 121. The upper insulation molded body 131 insulates the upper plate coil 136 from the primary coil module 120 and the upper core 111 through regions that cover the upper and lower portions of the upper plate coil 136.

Accordingly, an insulation distance may be secured between the upper plate coil 136 and the primary coil module 120, and an insulation distance may be secured between the upper plate coil 136 and the upper core 111. The upper insulation molded body 131 has through-holes formed in the center thereof to pass the second leg 111*b* of the upper core 111 therethrough. The upper insulation molded body 131 may be formed in a rectangular plate shape, and may come in surface contact with the primary coil module 120 and the upper core 111.

The upper plate coil 136 is buried in the upper insulation molded body 131 in a state where end portions of the upper plate coil 136 are exposed. The upper plate coil 136 is arranged to face the conductor pattern 122 of the primary coil module 120 in a surface-to-surface manner. The upper plate coil 136 generates an induced voltage through electromagnetic induction with the conductor pattern 122.

The lower secondary coil module 140 includes a lower insulation molded body 141 and a lower plate coil 146. The lower insulation molded body 141 is arranged in the magnetic core 110 to come in contact with the lower side of the insulating substrate 121. The lower insulation molded body 141 insulates the lower plate coil 146 from the primary coil module 120 and the lower core 112 through regions that cover the upper and lower portions of the lower plate coil 146.

Accordingly, an insulation distance may be secured between the lower plate coil 146 and the primary coil module 120, and an insulation distance may be secured between the lower plate coil 146 and the lower core 112. The lower insulation molded body 141 has through-holes formed in the center thereof to pass the second leg 112*b* of the lower core 112 therethrough. The lower insulation molded body 141 may be formed in a rectangular plate shape, and may come in surface contact with the primary coil module 120 and the lower core 112.

The lower plate coil 146 is buried in the lower insulation molded body 141 in a state where end portions of the lower plate coil 146 are exposed. The lower plate coil 146 is arranged to face the conductor pattern 122 of the primary coil module 120 in a surface-to-surface manner. The lower plate coil 146 generates an induced voltage through electromagnetic induction with the conductor pattern 122. The lower plate coil 146 may be connected to the upper plate coil 136 by wire.

As described above, since the upper and lower plate coils 136 and 146 are in a plate shape and face the conductor pattern 122 of the primary coil module 120 in a surface-to-surface manner, the coupling coefficient between the upper and lower plate coils 136 and 146 and the conductor pattern 122 of the primary coil module 120 can be heightened. Since the upper and lower secondary coil modules 130 and 140 are arranged on the upper and lower sides in a state where the primary coil module 120 is interposed between the upper and lower secondary coil modules 130 and 140, the upper and lower plate coils 136 and 146 can be arranged maximally close to the conductor pattern 122. Accordingly, leakage inductance can be reduced.

Further, since the upper and lower insulation molded bodies 131 and 141 are formed to bury the upper and lower plate coils 136 and 146 that are plate-shaped therein, the assembly procedures can be reduced in comparison to a case where the upper and lower plate coils 136 and 146 are assembled to an insulation member. Further, since the thickness of the upper and lower insulation molded bodies 131 and 141 becomes thin, the transformer 100 can be miniaturized with a reduced height, and thus an air flow for cooling can be formed inside an adaptor to the extent of the reduced height of the transformer 100 in a state where the transformer 100 is mounted in the adaptor to cause the temperature of the adaptor to be reduced.

For example, as illustrated in FIGS. 3 and 4, the upper plate coil 136 includes a first upper plate coil member 137 and a second upper plate coil member 138, and the lower plate coil 146 includes a first lower plate coil member 147 and a second lower plate coil member 148.

The first upper plate coil member 137 has both end portions drawn from a front surface of the upper insulation molded body 131 and an intermediate region wound in a circumferential direction of the upper insulation molded body 131 and buried in the upper insulation molded body 131. The intermediate region of the first upper plate coil member 137 may be wound in a "U" shape.

The second upper plate coil member 138 has both end portions drawn from the front surface of the upper insulation molded body 131 and between the both end portions of the first upper plate coil member 137 and an intermediate region wound to be spaced apart from an inside of the first upper plate coil member 137 and to be buried in the upper insulation molded body 131. The intermediate region of the second upper plate coil member 138 may be wound in a "U" shape. The respective intermediate regions of the first and second upper plate coil members 137 and 138 are positioned on the same plane.

The first lower plate coil member 147 has both end portions drawn from a front surface of the lower insulation molded body 141 and an intermediate region wound in a circumferential direction of the lower insulation molded body 141 and buried in the lower insulation molded body 141. The intermediate region of the first lower plate coil member 147 may be wound in a "U" shape.

The second lower plate coil member 148 has both end portions drawn from the front surface of the lower insulation molded body 141 and between the both end portions of the first lower plate coil member 147 and an intermediate region wound to be spaced apart from an inside of the first lower plate coil member 147 and to be buried in the lower insulation molded body 141. The intermediate region of the second lower plate coil member 148 may be wound in a "U" shape.

The respective intermediate regions of the first and second lower plate coil members 147 and 148 are positioned on the same plane. The respective intermediate regions of the first and second lower plate coil members 147 and 148 have the same shape as the shape of the respective intermediate regions of the first and second upper plate coil members 137 and 138.

The respective both end portions of the first and second upper plate coil members 137 and 138 are drawn from the upper insulation molded body 131 with the same length and are bent downward to be connected to the adaptor substrate 10. The respective both end portions of the first and second lower plate coil members 147 and 148 are drawn from the lower insulation molded body 141 with the same length and are bent downward to be connected to the adaptor substrate 10.

The respective both end portions of the first and second lower plate coil members 147 and 148 are drawn out to be shorter than the respective both end portions of the first and second upper plate coil members 137 and 138, and thus do not interfere with the respective both end portions of the first and second upper plate coil members 137 and 138.

The first and second upper plate coil members 137 and 138 and the first and second lower plate coil members 147 and 148 may be connected by wire through a circuit pattern of the adaptor substrate 10. For example, one end portion of the first upper plate coil member 137 and one end portion of the second lower plate coil member 148 are connected by wire. One end portion of the first lower plate coil member 147 and one end portion of the second upper plate coil member 138 are connected by wire. The other end portion of the second upper plate coil member 138 and the other end portion of the second lower plate coil member 148 are connected by wire.

Figure 5:
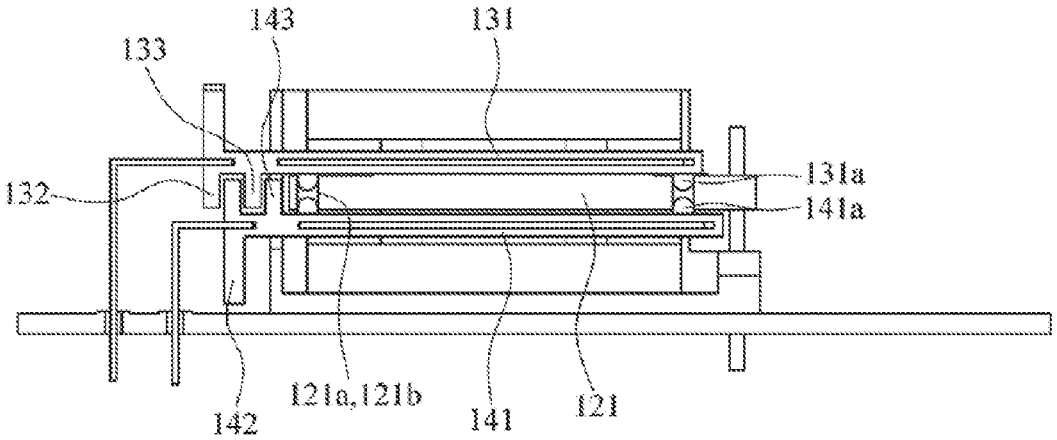
FIG. 5 is a side cross-sectional view of the transformer of FIG. 1.

On the other hand, first alignment projections 131*a* may be formed on any one of the insulating substrate 121 and the upper insulation molded body 131, and first alignment grooves 121*a*, into which the first alignment projections 131*a* are inserted, may be formed on the other of the insulating substrate 121 and the upper insulation molded body 131. Accordingly, as illustrated in FIG. 5, if the first alignment projections 131*a* are respectively inserted into the first alignment grooves 121*a*, the upper secondary coil module 130 may be aligned with respect to the primary coil module 120.

Further, second alignment projections 141*a* may be formed on any one of the insulating substrate 121 and the lower insulation molded body 141, and second alignment grooves 121*b*, into which the second alignment projections 141*a* are inserted, may be formed on the other of the insulating substrate 121 and the lower insulation molded body 141. Accordingly, if the second alignment projections 141*a* are respectively inserted into the second alignment grooves 121*b*, the lower secondary coil module 140 may be aligned with respect to the primary coil module 120.

Accordingly, assemblability between the upper and lower secondary coil modules 130 and 140 and the primary coil module 120 can be improved, and the coupling coefficient between the upper and lower plate coils 136 and 146 and the conductor pattern 122 can be uniformly implemented. The second alignment groove 121*b* may be penetratingly connected to the first alignment groove 121*a*.

On the other hand, the lower insulation molded body 141 may further include a lower flange 142 and a lower alignment rib 143. The lower flange 142 projects along the circumference of the front surface of the lower insulation molded body 141. The lower alignment rib 143 projects from the lower flange 142 to the rear side to be spaced apart from the upper surface thereof.

The upper insulation molded body 131 may further include an upper flange 132 and an upper alignment rib 133. The upper flange 132 projects in front of the lower flange 142 along the circumference of the front surface of the upper insulation molded body 131. The upper alignment rib 133 projects from the upper flange 132 to the rear side to be spaced apart from the lower surface thereof, and an upper end region of the lower flange 143 is fitted between the upper flange 132 and the upper alignment rib 133. Further, the upper alignment rib 133 is fitted between the lower flange 142 and the lower alignment rib 143. Accordingly, as illustrated in FIG. 5, the upper insulation molded body 131 and the lower insulation molded body 141 may be supported in an alignment state.

As another example, although not illustrated, the lower end region of the upper flange 132 may be fitted between the lower flange 142 and the lower alignment rib 143, and the lower alignment rib 143 may be fitted between the upper flange 132 and the upper alignment rib 133.

Figure 6:
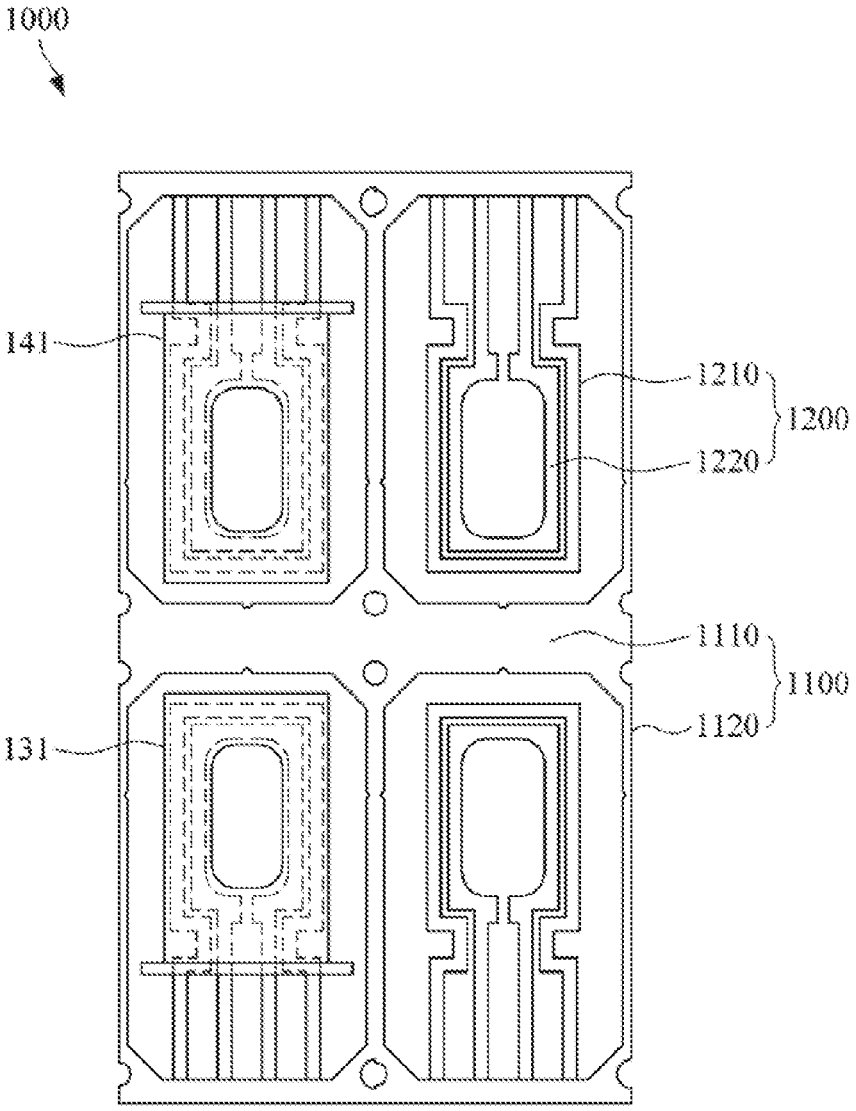
FIG. 6 is a plan view of a plate coil molded body used in upper and lower plate coils in FIG. 4.

On the other hand, the upper and lower plate coils 136 and 146 may be obtained through a sheet metal process or bending process. For example, as illustrated in FIG. 6, through the sheet metal process, a plate coil molded body 1000 is manufactured to include a frame 1100 and a plate coil 1200. The frame 1100 is formed to limit at least one accommodation space through connection of horizontal frames 1110 and vertical frames 1120.

The plate coil 1200 is formed to include a first plate coil member 1210 having both end portions connected to the horizontal frame 1110 and an intermediate region wound in a "U" shape in the accommodation space of the frame, and a second plate coil member 1220 having both end portions drawn between the both end portions of the first plate coil member 1210 to be connected to the horizontal frame 1110 and an intermediate region wound in a "U" shape to be spaced apart from an inside of the first plate coil member 1210.

A plurality of frames 1100 may be formed to limit arrangement of a plurality of accommodation spaces in horizontal and vertical directions. In addition, a plurality of plate coils 1200 may be formed to be accommodated in the accommodation spaces and to be arranged in the horizontal and vertical directions so that the plate coils 1200 are arranged in the same shape along the horizontal direction and are arranged symmetrically about a horizontal axis along the vertical direction.

In this case, since the plurality of plate coils 1200 are formed at the same time, productivity can be heightened. After the plate coil molded body 1000 is manufactured as described above, the plate coils 1200 may be separated from the frames 1100 and may be used as the upper and lower plate coils 136 and 146 through the bending process.

The upper and lower secondary coil modules 130 and 140 may be manufactured through insert injection molding. Specifically, if the upper and lower insulation molded bodies 131 and 141 are injection-molded through supply of injection resin to an injection mold after the upper and lower plate coils 136 and 146 are inserted into the injection mold, the upper and lower secondary coil modules 130 and 140 may be manufactured.

In the case where the plate coil molded body 1000 is inserted into the injection mold, the upper insulation molded body 131 may be injection-molded in one of the two plate coils 1200 and the lower insulation molded body 141 may be injection-molded in the other of the two plate coils 1200 to be separated from the frame 1100.

Since the upper and lower secondary coil modules 130 and 140 are manufactured by the insert injection molding, the upper and lower plate coils 136 and 146 may be buried in the upper and lower insulation molded bodies 131 and 141 to be fixed to the upper and lower insulation molded bodies 131 and 141.

Further, the upper and lower secondary coil modules 130 and 140 may have a structure in which the winding positions of the upper and lower plate coils 136 and 146 are standardized. In addition, since the primary coil module 120 also has a structure in which the winding position of the conductor pattern 122 is standardized, in comparison to the wire winding, the coupling coefficient between the upper and lower plate coils 136 and 146 and the conductor pattern 122 can be uniformly implemented, and it becomes possible to implement and manage uniform leakage inductance.

In addition, since the manufacturing of the primary coil module 120 and the upper and lower secondary coil modules 130 and 140 is automated, manpower can be reduced and productivity can be improved in comparison to a case where wires are manually wound and processed to be insulated.

Second Embodiment

Figure 7:
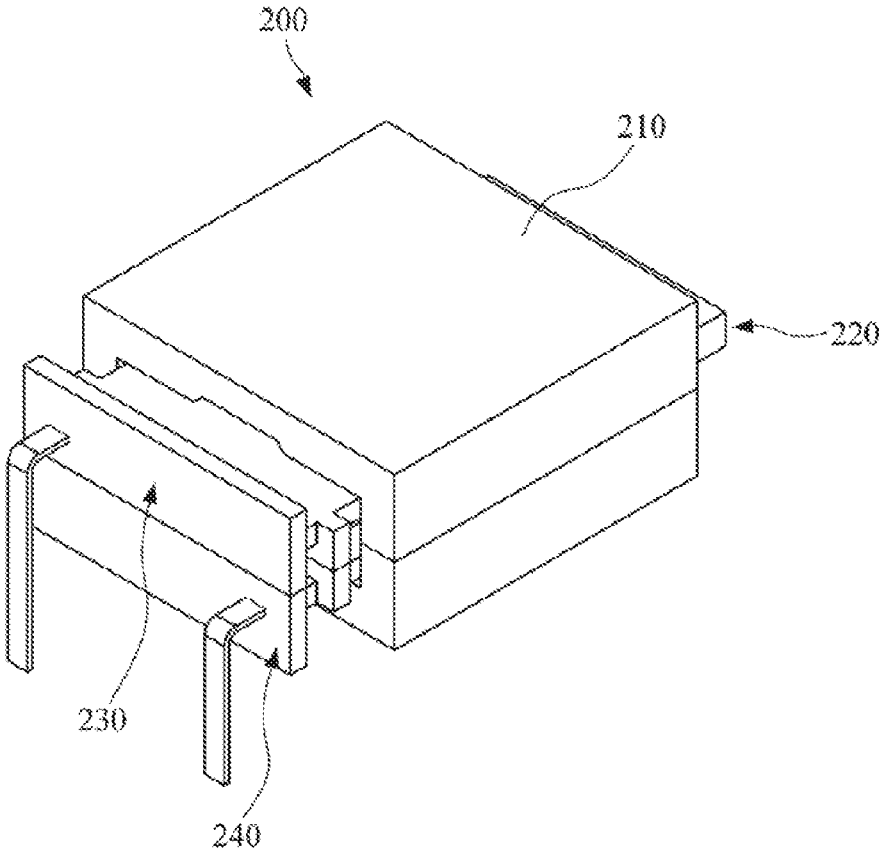
FIG. 7 is a perspective view of a transformer according to a second embodiment of the present disclosure.
Figure 8:
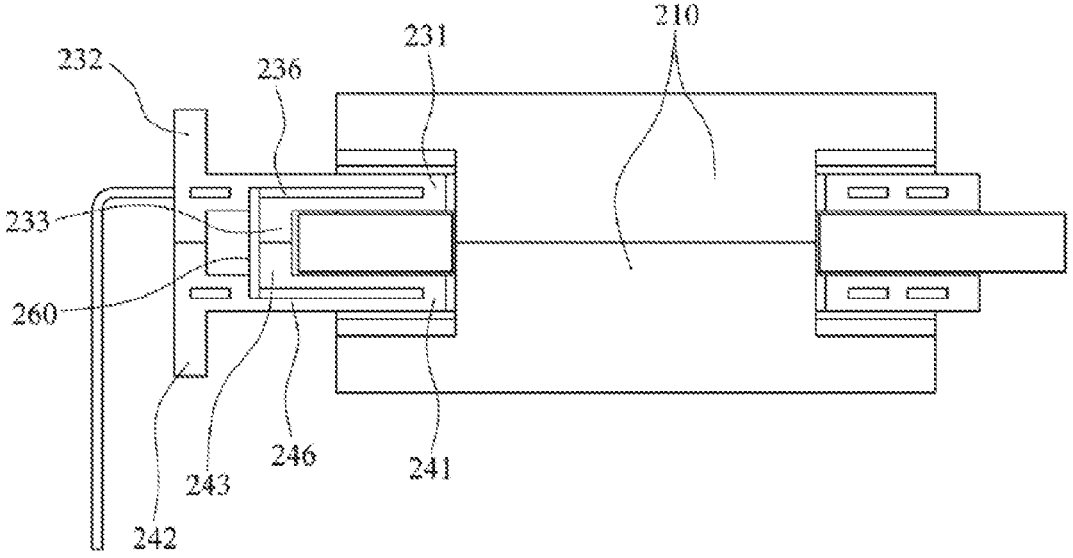
FIG. 8 is a side cross-sectional view of the transformer of FIG. 7.
Figure 9:
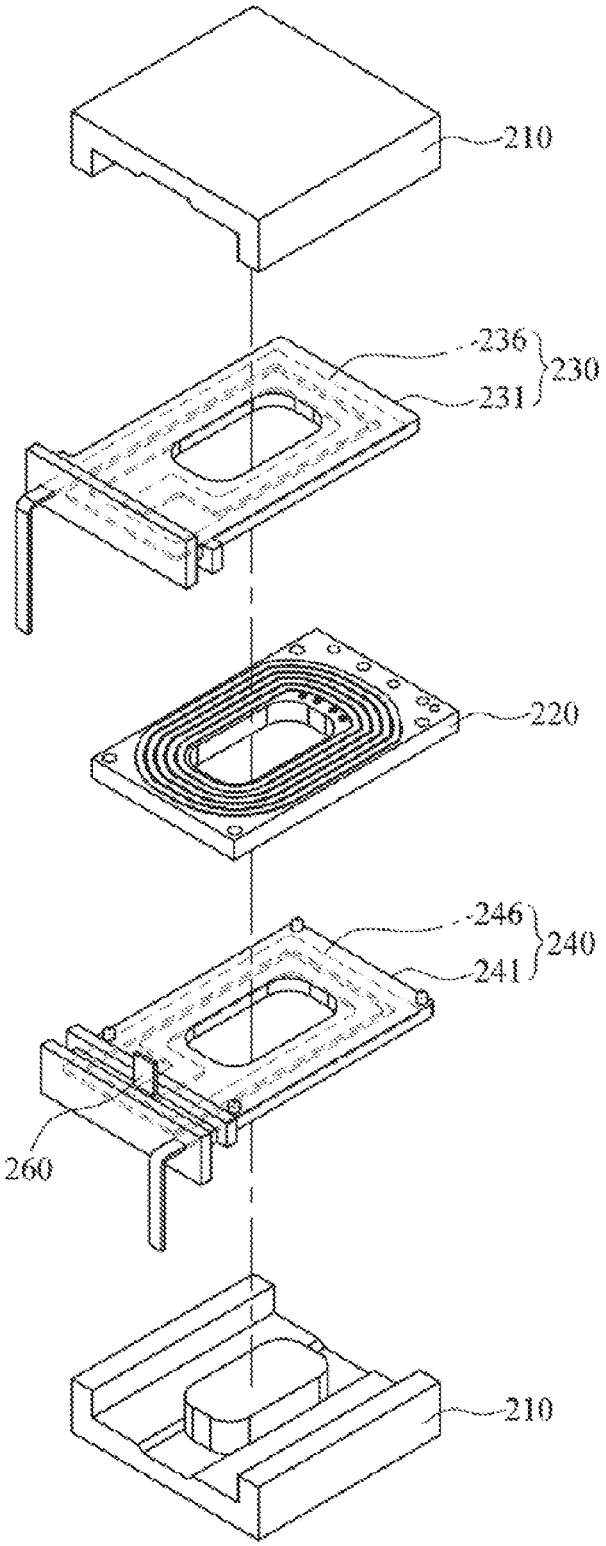
FIG. 9 is an exploded perspective view of the transformer of FIG. 7.
Figure 10:
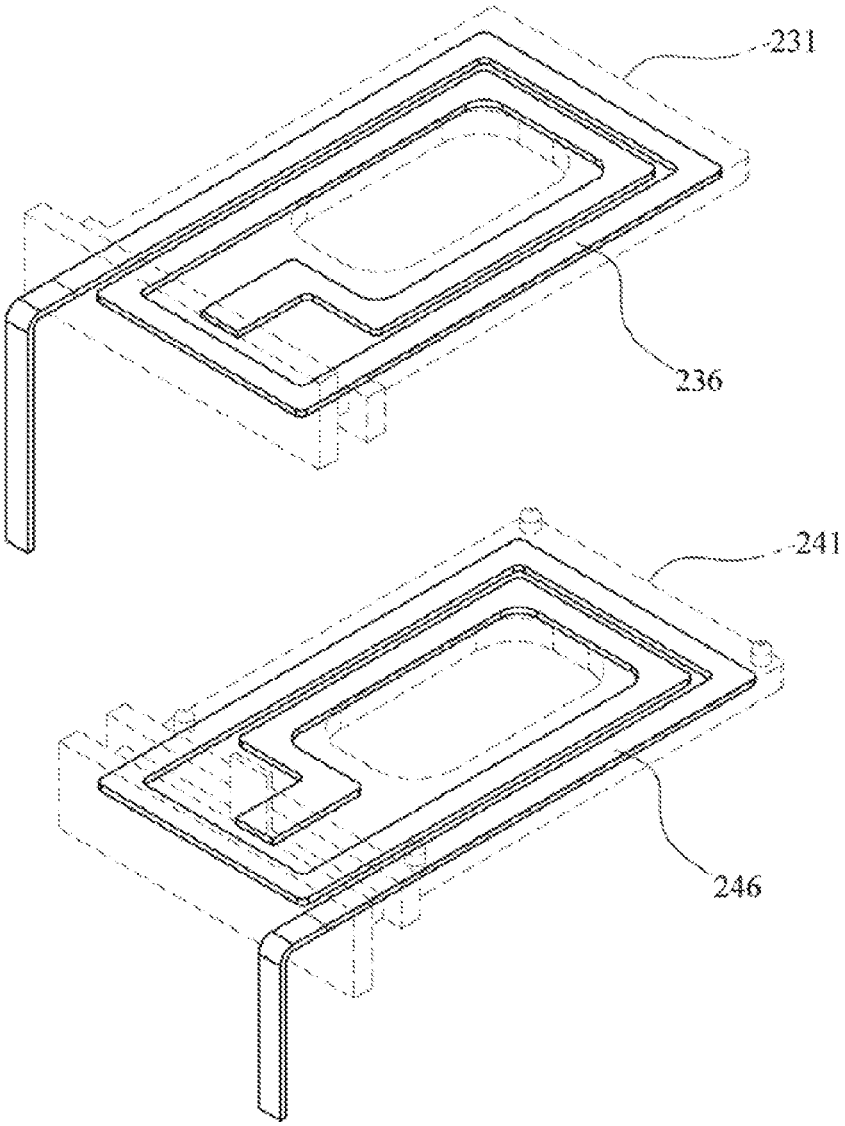
FIG. 10 is a perspective view of upper and lower secondary coil modules extracted from the transformer of FIG. 9.

FIG. 7 is a perspective view of a transformer according to a second embodiment of the present disclosure, and FIG. 8 is a side cross-sectional view of the transformer of FIG. 7. FIG. 9 is an exploded perspective view of the transformer of FIG. 7, and FIG. 10 is a perspective view of upper and lower secondary coil modules extracted from the transformer of FIG. 9.

Referring to FIGS. 7 to 10, a transformer 200 according to a second embodiment of the present disclosure includes a magnetic core 210, a primary coil module 220, an upper secondary coil module 230, and a lower secondary coil module 240. Here, the magnetic core 210 and the primary coil module 220 according to this embodiment may be constructed in the same manner as the magnetic core 110 and the primary coil module 120 according to the first embodiment.

An upper plate coil 236 has inner and outer end portions that are exposed from an upper insulation molded body 231 and an intermediate region wound in a spiral shape to be buried in the upper insulation molded body 231. A lower plate coil 246 has inner and outer end portions that are exposed from a lower insulation molded body 241 and an intermediate region wound in a spiral shape to be buried in the lower insulation molded body 241. The intermediate region of the lower plate coil 246 is wound in a spiral shape in an opposite direction to the winding direction of the upper plate coil 236. The intermediate regions of the upper and lower plate coils 236 and 246 may be wound roughly in a rectangular spiral shape.

For example, the inner end portion of the upper plate coil 236 and the inner end portion of the lower plate coil 246 are connected by wire through a wire connection member 260. The inner end portion of the upper plate coil 236 and the inner end portion of the lower plate coil 246 are arranged up and down to face each other. The inner end portion of the upper plate coil 236 is exposed through an insertion groove that is formed on the lower surface of the upper insulation molded body 231. The inner end portion of the lower plate coil 246 is exposed through an insertion groove that is formed on the upper surface of the lower insulation molded body 241.

The wire connection member 260 is insertion-coupled to insertion grooves of the upper and lower insulation molded bodies 231 and 241 in a state where both end portions of the wire connection member 260 come in contact with the inner end portion of the upper plate coil 236 and the inner end portion of the lower plate coil 246. The wire connection member 260 is composed of a rectangular metal piece having conductivity.

The outer end portion of the upper plate coil 236 may be drawn through the front surface of the upper insulation molded body 231 to be bent downward. The outer end portion of the lower plate coil 246 may be drawn through the front surface of the lower insulation molded body 241 to be bent downward. The outer end portions of the upper and lower plate coils 236 and 246 are connected to a circuit pattern of an adaptor substrate.

On the other hand, the lower insulation molded body 241 may further include a first lower flange 242 and a second lower flange 243. The first lower flange 242 projects along the circumference of the front surface of the lower insulation molded body 241. The second lower flange 243 is rearwardly spaced apart from the first lower flange 242 and projects from the left, right, and upper sides of the circumference of the front surface of the lower insulation molded body 241.

The upper insulation molded body 231 may further include a first upper flange 232 and a second upper flange 233. The first upper flange 232 projects along the circumference of the front surface of the upper insulation molded body 231, and the lower end region of the first upper flange 232 comes in contact with the upper end region of the first lower flange 242. The second upper flange 233 is rearwardly spaced apart from the first upper flange 232, and projects from the left, right, and lower sides of the circumference of the front surface of the upper insulation molded body 231, so that the lower end region of the second upper flange 233 comes in contact with the upper end region of the second lower flange 243. Accordingly, the upper insulation molded body 231 and the lower insulation molded body 241 may be supported by each other.

Figure 11:
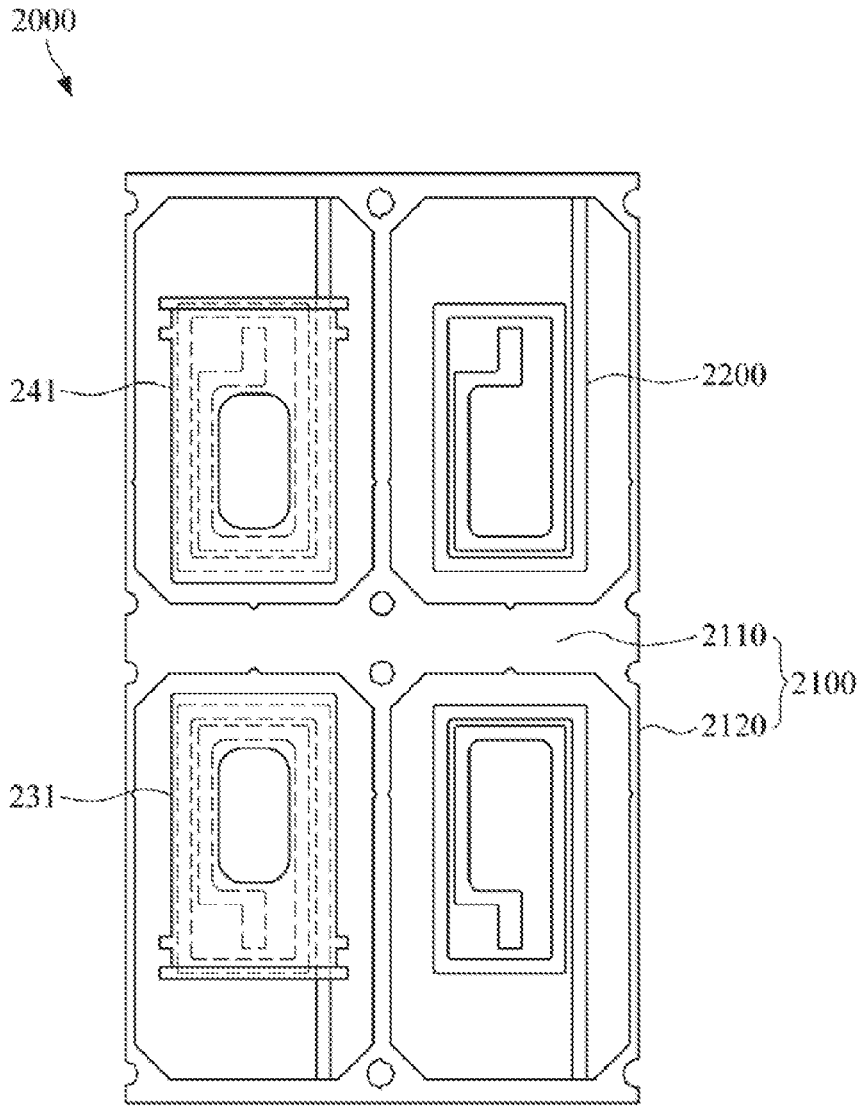
FIG. 11 is a plan view of a plate coil molded body used in upper and lower plate coils in FIG. 10.

Like the first embodiment, the upper insulation molded body 231 may be aligned with respect to an insulating substrate 221 by first alignment projections and first alignment grooves, and the lower insulation molded body 241 may be aligned with respect to the insulating substrate 221 by second alignment projections and second alignment grooves. The upper and lower molded bodies 231 and 241 are vertically symmetrical to each other. Although not illustrated, like the first embodiment, the magnetic core 210 may be accommodated in a base member, and pin-fixing holes for penetratingly fixing outer lead pins may be formed at the rear region of the base member. On the other hand, the upper and lower plate coils 236 and 246 may be obtained through a sheet metal process or bending process. For example, as illustrated in FIG. 11, through the sheet metal process, a plate coil molded body 2000 is manufactured to include a frame 2100 and a plate coil 2200. The frame 2100 is formed to limit at least one accommodation space through connection of horizontal frames 2110 and vertical frames 2120.

The plate coil 2200 is formed in a manner that an outer end portion thereof is connected to the horizontal frame 2110, an inner end portion thereof is arranged in parallel to the outer end portion, and an intermediate region thereof is wound in a spiral shape from the outer end portion to be connected to the inner end portion in the accommodation space of the frame 2100.

A plurality of frames 2100 may be formed to limit arrangement of a plurality of accommodation spaces in horizontal and vertical directions. In addition, a plurality of plate coils 2200 are formed to be accommodated in the accommodation spaces and to be arranged in the horizontal and vertical directions so that the plate coils 2200 are arranged in the same shape along the horizontal direction and are arranged symmetrically about a horizontal axis along the vertical direction. After the plate coil molded body 2000 is manufactured as described above, the plate coils 2200 are separated from the frames 2100 and may be used as the upper and lower plate coils 236 and 246 through the bending process.

The upper and lower secondary coil modules 230 and 240 may be manufactured through insert injection molding. In the case where the plate coil molded body 2000 is inserted into an injection mold, the upper insulation molded body 231 is injection-molded in one of two plate coils 2200 that are adjacent to each other in the horizontal direction, and the lower insulation molded body 241 is injection-molded in the other thereof to be separated from the frames 2100, respectively.

Third Embodiment

Figure 12:
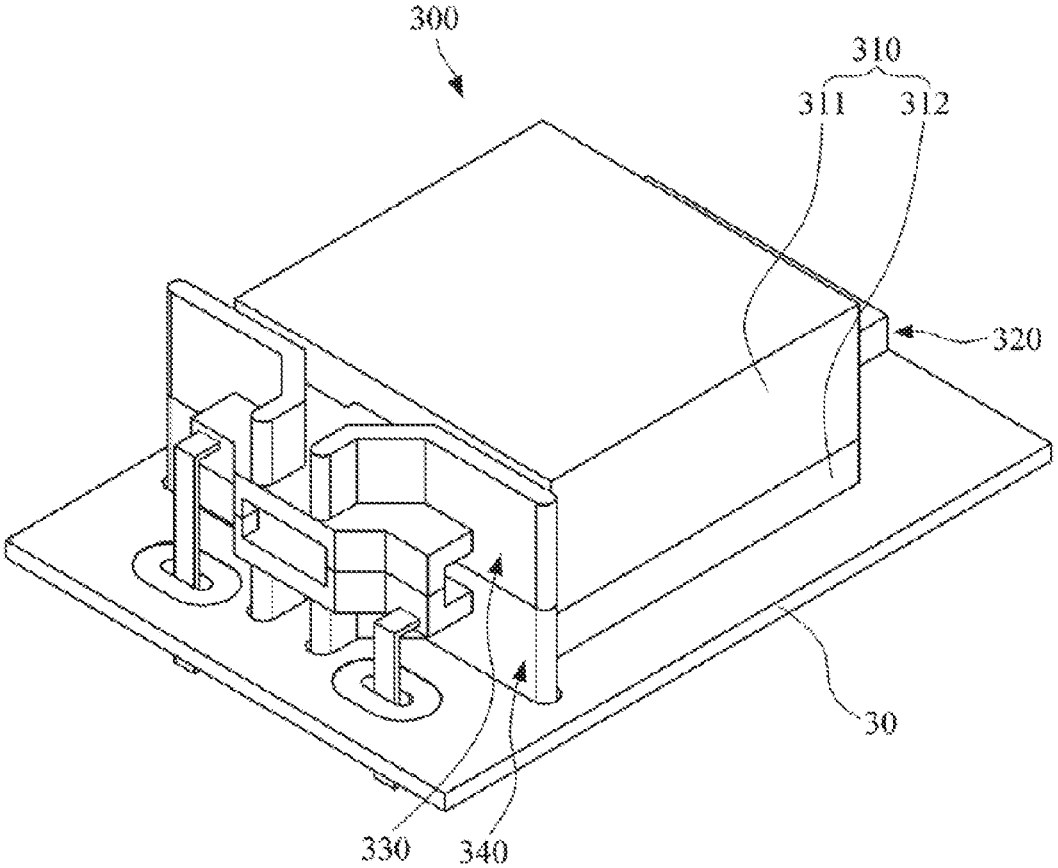
FIG. 12 is a perspective view of a transformer according to a third embodiment of the present disclosure.
Figure 13:
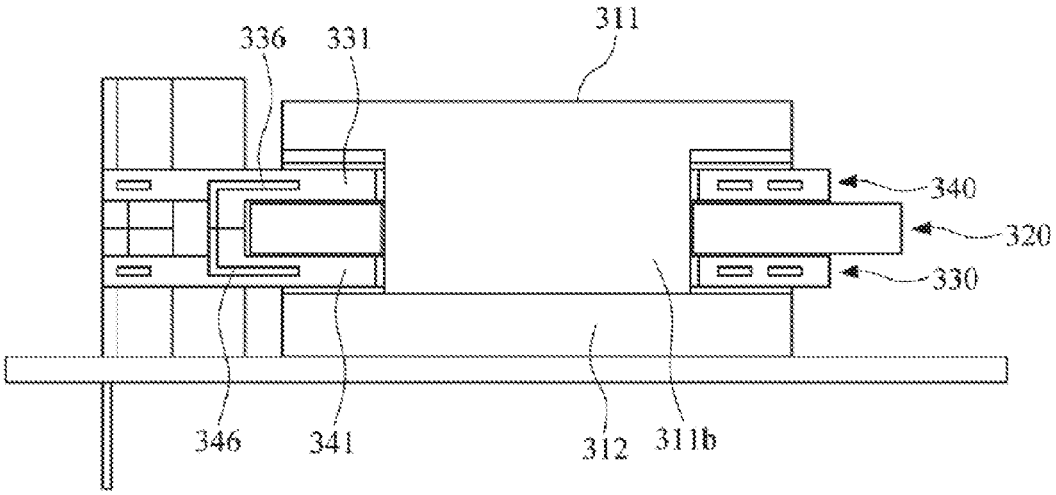
FIG. 13 is a side cross-sectional view of the transformer of FIG. 12.
Figure 14:
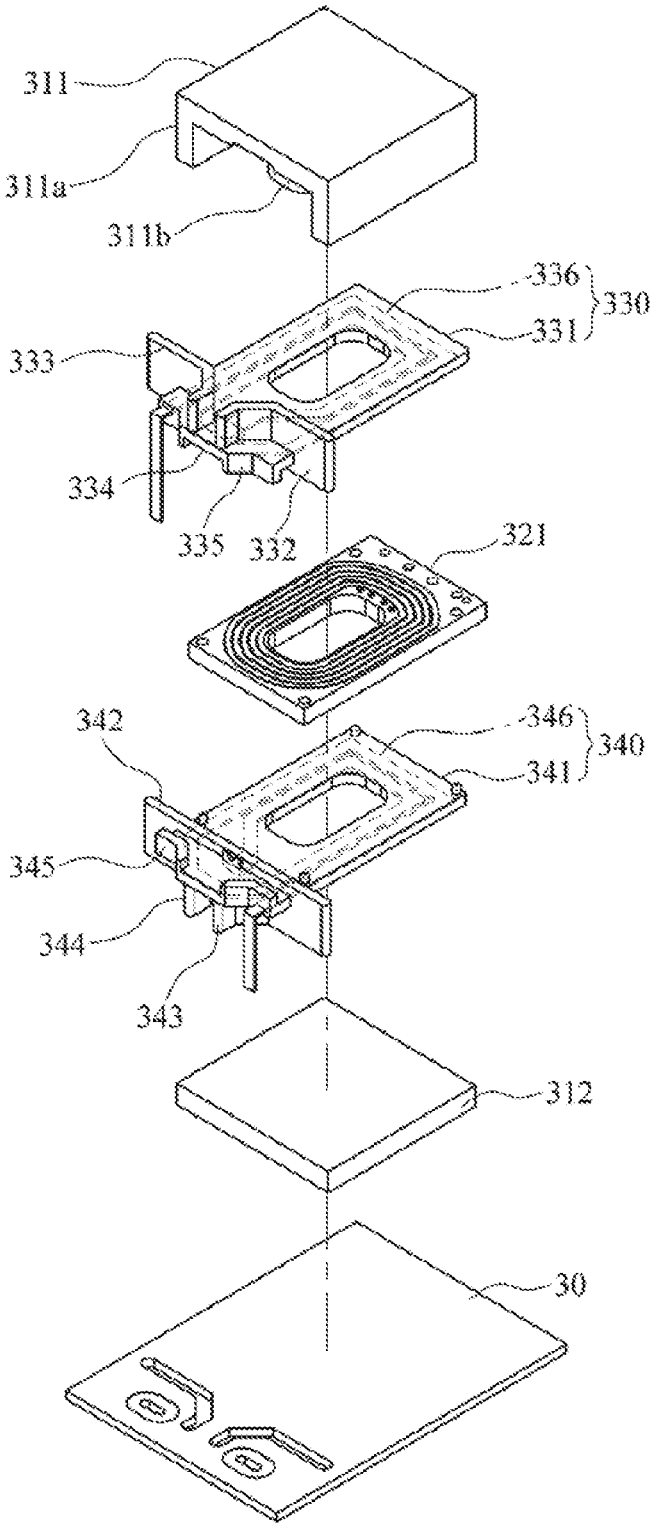
FIG. 14 is an exploded perspective view of the transformer of FIG. 12.
Figure 15:
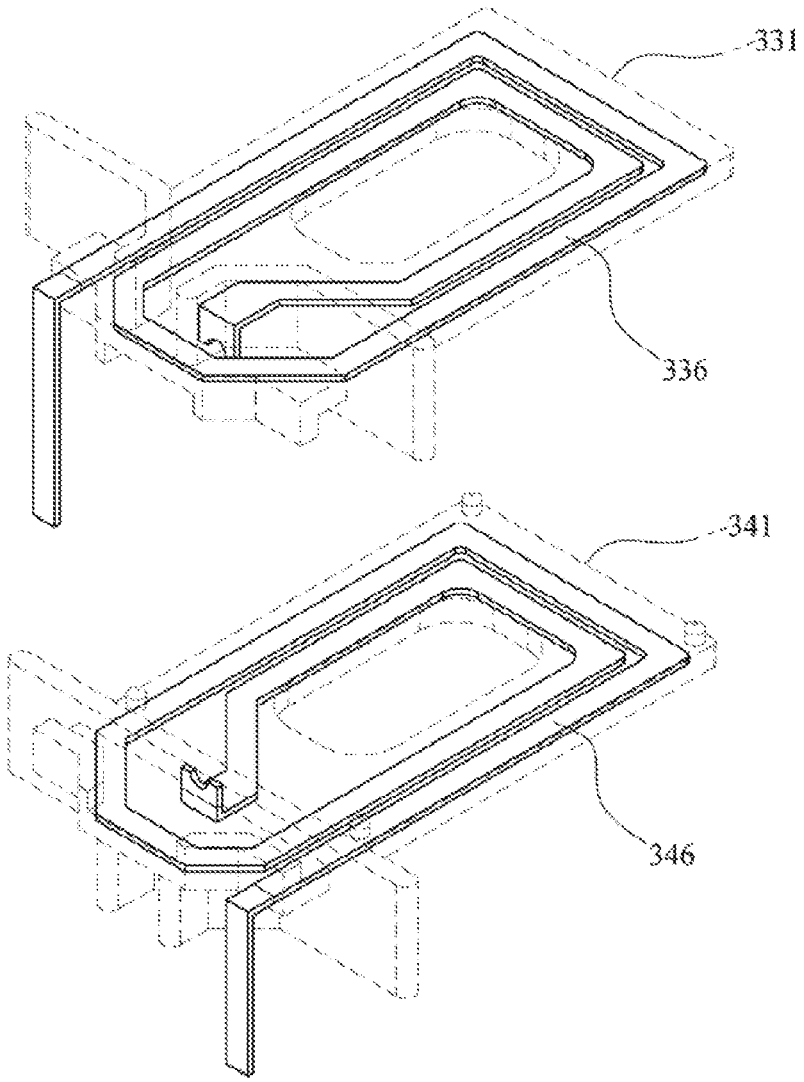
FIG. 15 is a perspective view of upper and lower secondary coil modules extracted from the transformer of FIG. 14.

FIG. 12 is a perspective view of a transformer according to a third embodiment of the present disclosure, and FIG. 13 is a side cross-sectional view of the transformer of FIG. 12. FIG. 14 is an exploded perspective view of the transformer of FIG. 12, and FIG. 15 is a perspective view of upper and lower secondary coil modules extracted from the transformer of FIG. 14.

Referring to FIGS. 12 to 15, a transformer 300 according to a third embodiment of the present disclosure includes a magnetic core 310, a primary coil module 320, an upper secondary coil module 330, and a lower secondary coil module 340. Here, the primary coil module 320 according to this embodiment may be constructed in the same manner as the primary coil module 120 according to the first embodiment.

An upper core 311 is formed in a manner that pairs of first legs 311*a* project from left and right edges of a lower surface of the upper core 311 to come in contact with left and right edges of an upper surface of a lower core 312, and a second leg 311*b* projects downward from the center of the lower surface to come in contact with the center of the upper surface of the lower core 312. The lower core 312 is formed in a flat plate shape. That is, the upper core 311 is formed of an "E"-shaped core and the lower core 312 is formed of an "I"-shaped core.

Respective intermediate regions of the upper and lower plate coils 336 and 346 are formed in a similar manner to the respective intermediate regions of the upper and lower plate coils 236 and 246 according to the second embodiment. An inner end portion of the upper plate coil 336 and an inner end portion of the lower plate coil 346 are drawn out in front of the upper and lower insulation molded bodies 331 and 341 and are bent to face each other and to come in contact with each other. A circular cut groove may be formed on the inner end portion of the upper plate coil 336, and a circular cut groove may be formed on the inner end portion of the lower plate coil 346. The inner end portion of the upper plate coil 336 and the inner end portion of the lower plate coil 346 may be connected by wire through soldering or a fastening member such as rivet.

The outer end portions of the upper and lower plate coils 336 and 346 may be drawn through the front surfaces of the upper and lower insulation molded bodies 331 and 341 to be bent downward. The outer end portions of the upper and lower plate coils 336 and 346 are connected to a circuit pattern of an adaptor substrate 30. The upper and lower plate coils 336 and 346 may be manufactured through a sheet metal process. The upper and lower secondary coil modules 330 and 340 may be manufactured through an insert injection.

On the other hand, the lower insulation molded body 341 may further include a first lower rib 342, a pair of second lower ribs 343, and a lower extension block 344. The first lower rib 342 projects from the left, right, and upper sides of the circumference of the front surface of the lower insulation molded body 341. The second lower ribs 343 project from the lower side of the circumference of the front surface of the lower insulation molded body 341 to be spaced apart from each other, and are bent toward the center of the front to be extended. The respective lower end regions of the second lower ribs 343 may be inserted into mount holes of the adaptor substrate 30 to be supported. The lower extension block 344 is extended to the front of the front surface of the lower insulation molded body 341.

The upper insulation molded body 331 may further include a first upper rib 332, a pair of second upper ribs 333, and an upper extension block 334. The first upper rib 332 projects from the left, right, and lower sides of the circumference of the front surface of the upper insulation molded body 331. The second upper ribs 333 project from the upper side of the circumference of the front surface of the upper insulation molded body 331 to be spaced apart from each other, and are bent toward the center of the front to be extended. The upper extension block 334 is extended to the front of the front surface of the upper insulation molded body 331.

As described above, the upper and lower extension blocks 334 and 344 are extended to the front of the front surfaces of the upper and lower insulation molded bodies 331 and 341, and even if a base member is omitted, an insulation distance between regions on which the respective outer end portions of the upper and lower plate coils 336 and 346 are connected to the adaptor substrate 30 and the upper and lower cores 311 and 312 can be further secured. Since the base member is omitted, the assembling processes and the costs can be reduced.

The upper extension block 334 and the lower extension block 344 are spaced apart from each other through first upper and lower ribs 332 and 342 to have a space. The inner end portions of the upper and lower plate coils 336 and 346 may be exposed to the space between the upper extension block 334 and the lower extension block 344 to be connected to each other by wire. A pair of third lower ribs 345 project to the left and right of the upper surface of the lower extension block 344, and a pair of third upper ribs 335 may project to the left and right of the lower surface of the upper extension block 334 to come in contact with the third lower ribs 345.

Like the first embodiment, the upper insulation molded body 331 may be aligned with respect to the insulating substrate 321 by first alignment projections and first alignment grooves, and the lower insulation molded body 341 may be aligned with respect to the insulating substrate 321 by second alignment projections and second alignment grooves.

Fourth Embodiment

Figure 16:
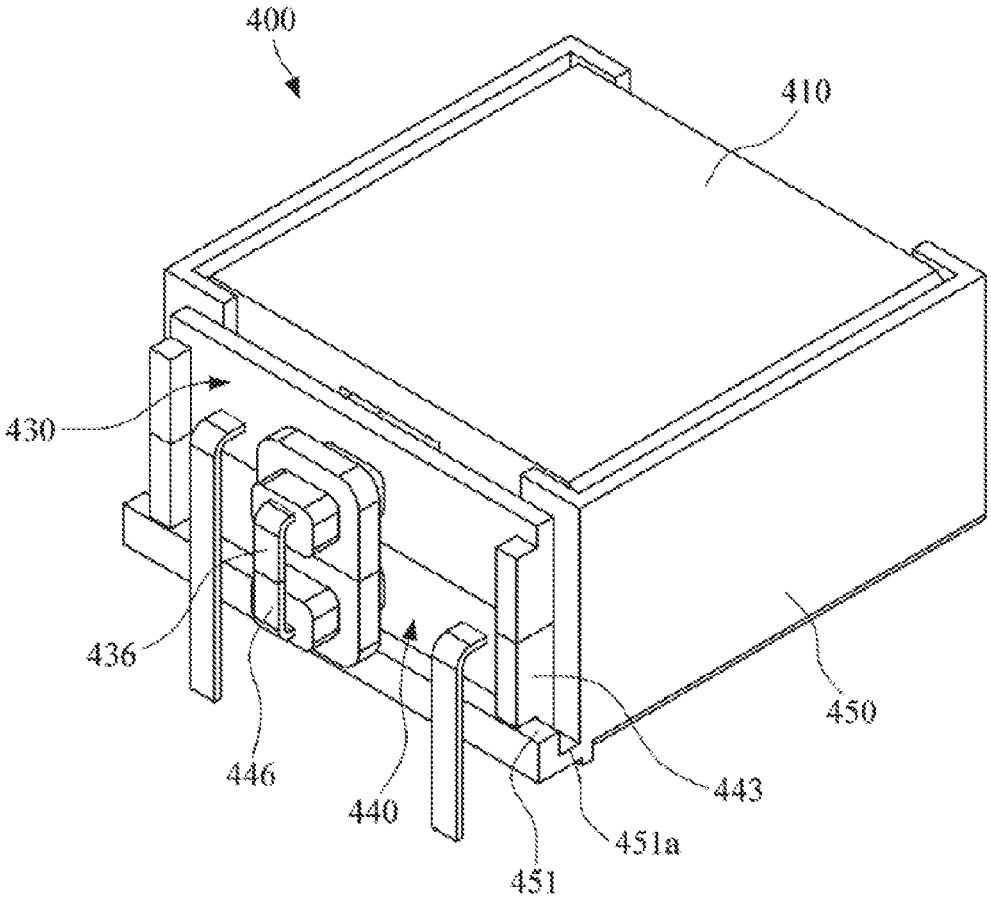
FIG. 16 is a perspective view of a transformer according to a fourth embodiment of the present disclosure.
Figure 17:
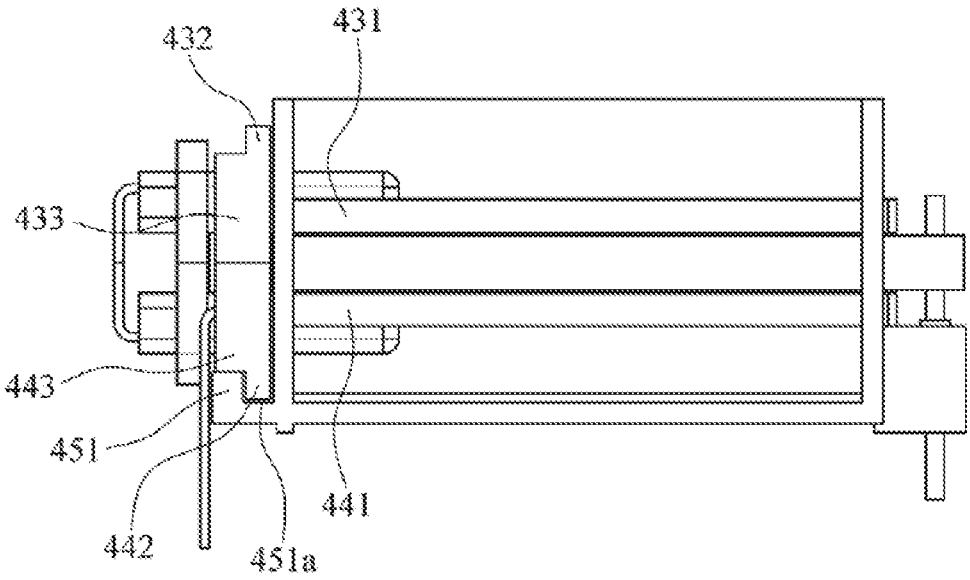
FIG. 17 is a side cross-sectional view of the transformer of FIG. 16.
Figure 18:
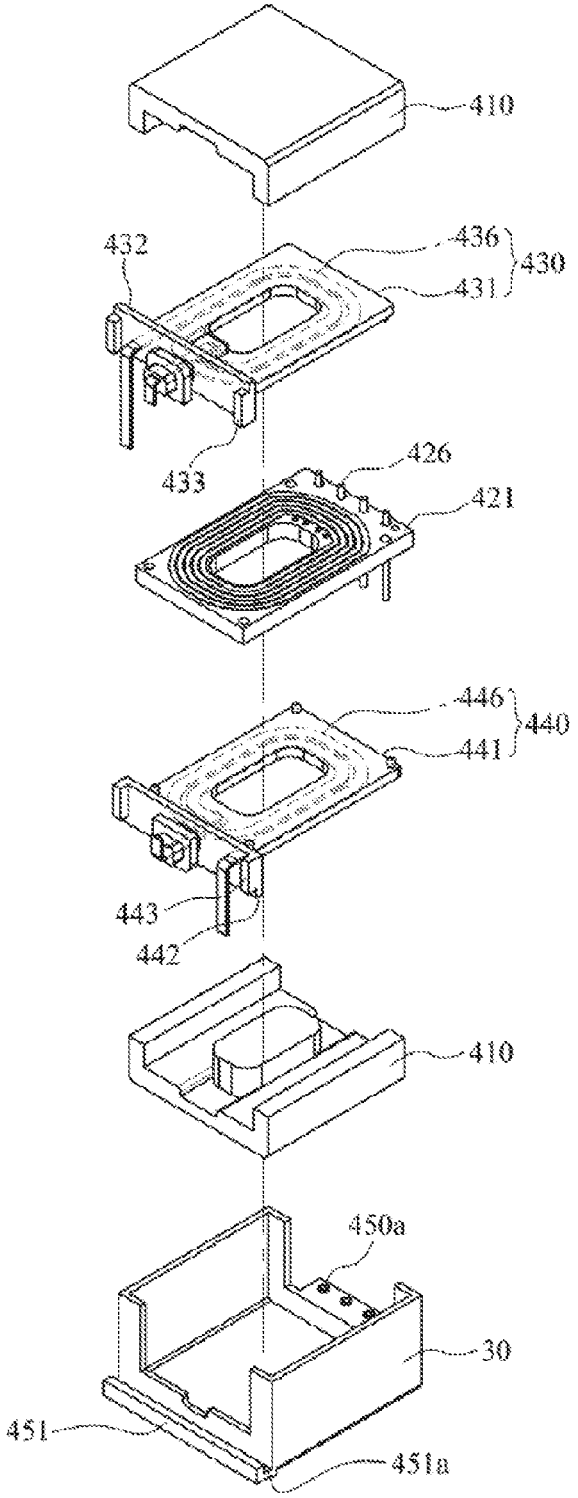
FIG. 18 is an exploded perspective view of the transformer of FIG. 16.
Figure 19:
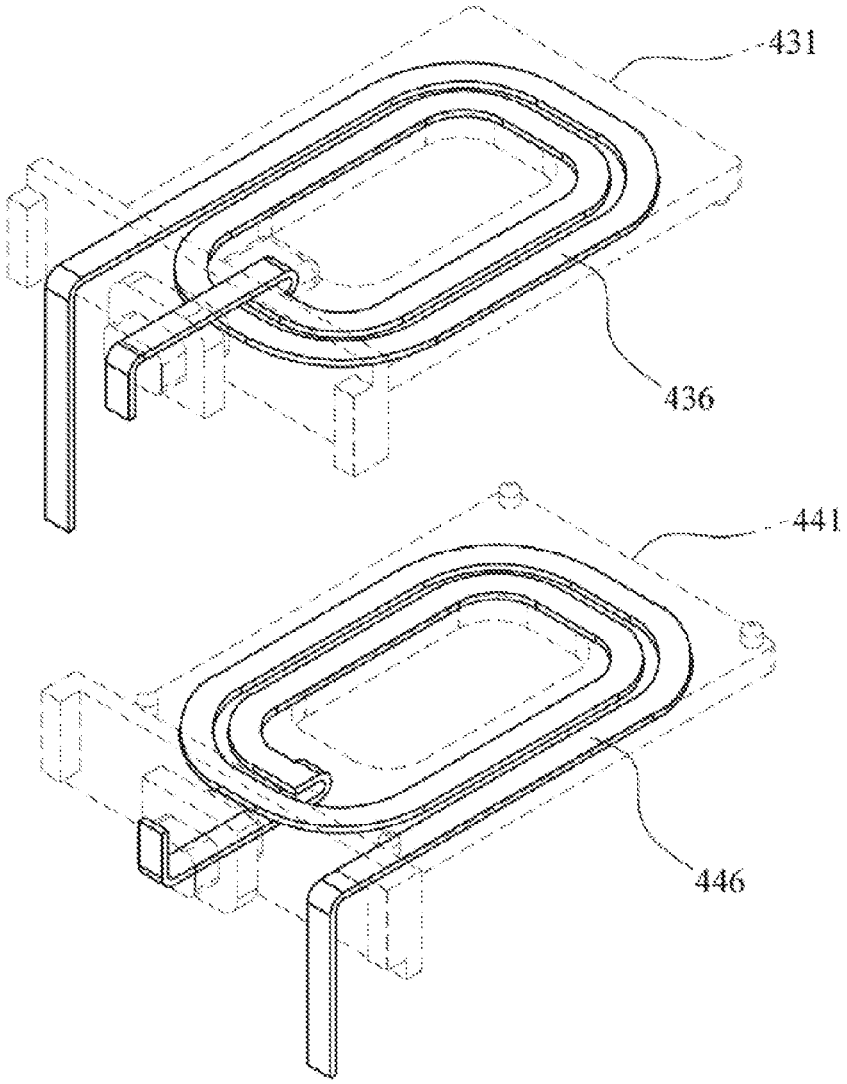
FIG. 19 is a perspective view of upper and lower secondary coil modules extracted from the transformer of FIG. 18.

FIG. 16 is a perspective view of a transformer according to a fourth embodiment of the present disclosure, and FIG. 17 is a side cross-sectional view of the transformer of FIG. 16. FIG. 18 is an exploded perspective view of the transformer of FIG. 16, and FIG. 19 is a perspective view of upper and lower secondary coil modules extracted from the transformer of FIG. 18.

Referring to FIGS. 16 to 19, a transformer 400 according to a fourth embodiment of the present disclosure includes a magnetic core 410, a primary coil module 420, an upper secondary coil module 430, and a lower secondary coil module 440. Here, the magnetic core 410 and the primary coil module 420 according to this embodiment may be constructed in the same manner as the magnetic core 110 and the primary coil module 120 according to the first embodiment.

An upper plate coil 436 has inner and outer end portions that are drawn from a front surface of an upper insulation molded body 431 and an intermediate region wound in a spiral shape from the outer end portion and then bent upward to be buried in the upper insulation molded body 431 in a state where the intermediate region is connected to the inner end portion.

A lower plate coil 446 has inner and outer end portions that are drawn from a front surface of a lower insulation molded body 441 and an intermediate region wound in a spiral shape from the outer end portion and then bent downward to be buried in the lower insulation molded body 441 in a state where the intermediate region is connected to the inner end portion. The intermediate region of the lower plate coil 446 is wound in a spiral shape in an opposite direction to the winding direction of the upper plate coil 436. The intermediate regions of the upper and lower plate coils 436 and 446 may be wound roughly in a rectangular spiral shape.

The inner end portion of the upper plate coil 436 and the inner end portion of the lower plate coil 446 are drawn from respective front surfaces of the upper and lower insulation molded bodies 431 and 441 and are bent to face each other and to come in contact with each other. The inner end portion of the upper plate coil 436 and the inner end portion of the lower plate coil 446 may be connected by wire through soldering or a fastening member.

The outer end portions of the upper and lower plate coils 436 and 446 may be drawn through the front surfaces of the upper and lower insulation molded bodies 431 and 441 to be bent downward. The outer end portions of the upper and lower plate coils 436 and 446 are connected to a circuit pattern of an adaptor substrate. The upper and lower plate coils 436 and 446 may be manufactured through a sheet metal process. The upper and lower secondary coil modules 430 and 440 may be manufactured through insert injection molding.

On the other hand, the lower insulation molded body 441 may further include a lower flange 442 and lower alignment step portions 443. The lower flange 442 projects along the circumference of the front surface of the lower insulation molded body 441. The lower alignment step portions 443 project from edges of the left, right, and upper sides of the lower flange 442 to the front side.

The upper insulation molded body 431 may further include an upper flange 432. The upper flange 432 projects along the circumference of the front surface of the upper insulation molded body 431, and the lower end region of the upper flange 432 comes in contact with the upper end region of the lower flange 442. The upper insulation molded body 431 may further include upper alignment step portions 433 so that the upper insulation molded body 431 is formed to be vertically symmetrical to the lower insulation molded body 441.

A base member 450 accommodates the magnetic core 410 in the inner space thereof through an upper opening thereof. On a rear end region of the base member 450, pin-fixing holes 450*a* for penetratingly fixing outer lead pins 426 to the rear end region of the base member 450 may be formed.

The base member 450 has left and right borders formed around a front opening to support rear surfaces of the upper and lower flanges 432 and 442. The front opening of the base member 450 makes the upper portion of the base member 450 in an open state. A support step portion 451 projects to the front of the base member 450 to support respective lower end regions of the lower alignment step portions 443 on the lower side of the front surface of the base member 450. The base member 450 has an insertion groove 451*a* that is formed on the upper surface of the support step portion 451 to make the lower end region of the lower flange 442 inserted into the insertion groove 451*a*. Accordingly, the upper and lower insulation molded bodies 431 and 441 may be supported in a state where the upper and lower insulation molded bodies 431 and 441 are aligned by the base member 450.

Like the first embodiment, the upper insulation molded body 431 may be aligned with respect to the insulating substrate 421 by first alignment projections and first alignment grooves, and the lower insulation molded body 441 may be aligned with respect to the insulating substrate 421 by second alignment projections and second alignment grooves.

Figure 20:
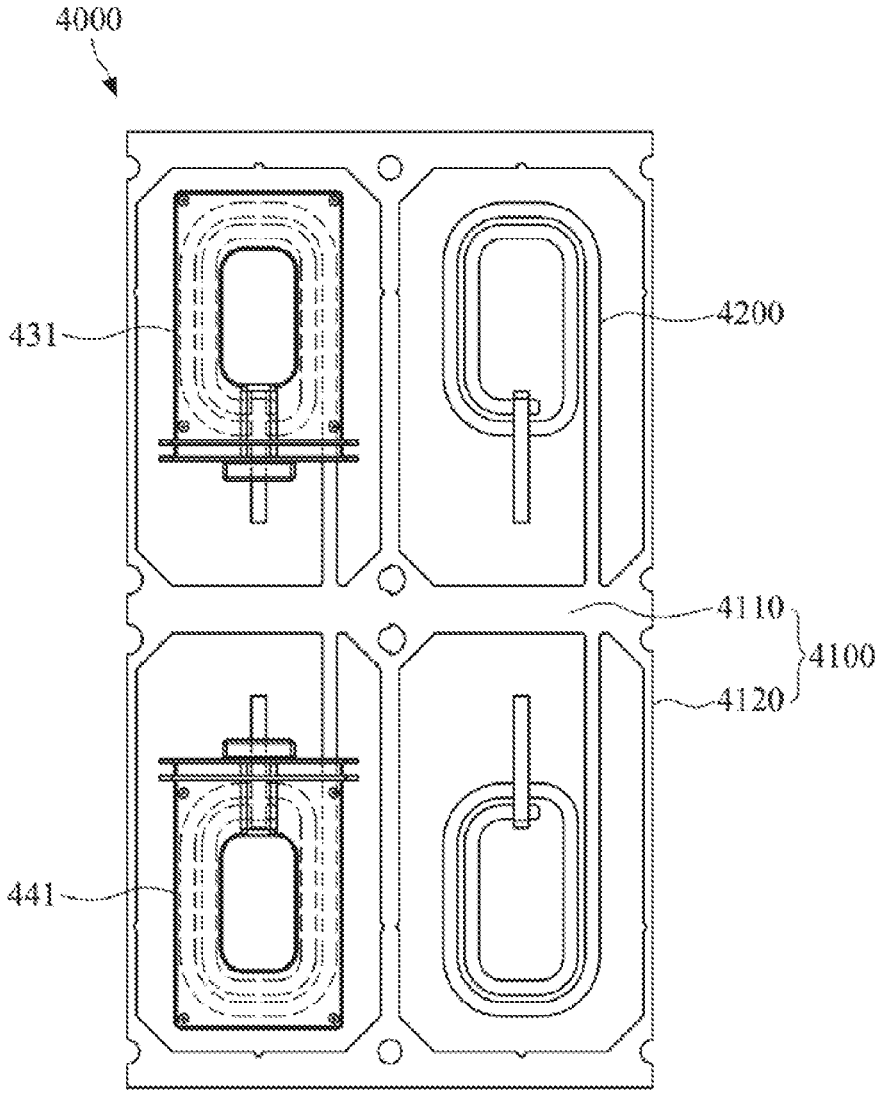
FIG. 20 is a plan view of a plate coil molded body used in upper and lower plate coils in FIG. 19.

On the other hand, the upper and lower plate coils 436 and 446 may be obtained through a sheet metal process and a bending process. For example, as illustrated in FIG. 20, through the sheet metal process and the bending process, a plate coil molded body 4000 is manufactured to include a frame 4100 and a plate coil 4200. The frame 4100 is formed to limit at least one accommodation space through connection of horizontal frames 4110 and vertical frames 4120.

The plate coil 4200 is formed to have an outer end portion connected to the horizontal frames 4110, an inner end portion arranged in parallel to the outer end portion, and an intermediate region wound in a spiral shape from the outer end portion and bent upward to be connected to the inner end portion in the accommodation space of the frame 4100.

A plurality of frames 4100 may be formed to limit arrangement of a plurality of accommodation spaces in horizontal and vertical directions. In addition, plate coils 4200 are formed to be accommodated in the accommodation spaces and to be arranged in the horizontal and vertical directions so that the plate coils 4200 are arranged in the same shape along the horizontal direction and are arranged symmetrically about a horizontal axis along the vertical direction. After the plate coil molded body 4000 is manufactured as described above, the plate coils 4200 may be separated from the frames 4100 to be used as the upper and lower plate coils 436 and 446.

In the case where the frames 4100 limit the accommodation spaces two by two in the horizontal and vertical directions, respective outer end portions of the plate coils 4200 that are arranged along the vertical direction may be connected to the middle horizontal frames 4110.

The upper and lower secondary coil modules 430 and 440 may be manufactured through insert injection molding. If the plate coil molded body 4000 is inserted into the injection mold, the upper insulation molded body 431 may be injection-molded in one of the two plate coils 4200 that are adjacent in the horizontal direction, and the lower insulation molded body 441 may be injection-molded in the other of the two plate coils 4200 to be separated from the frames 4100.

Fifth Embodiment

Figure 21:
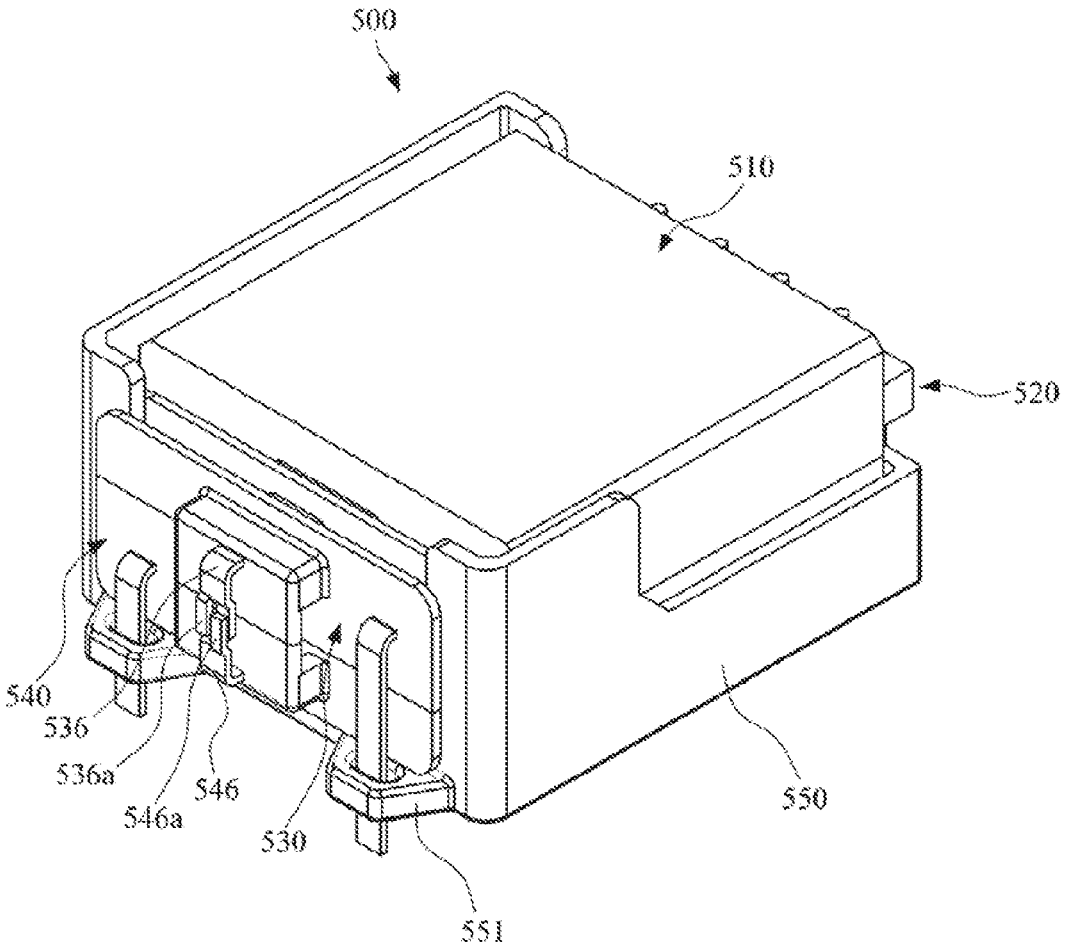
FIG. 21 is a perspective view of a transformer according to a fifth embodiment of the present disclosure.
Figure 22:
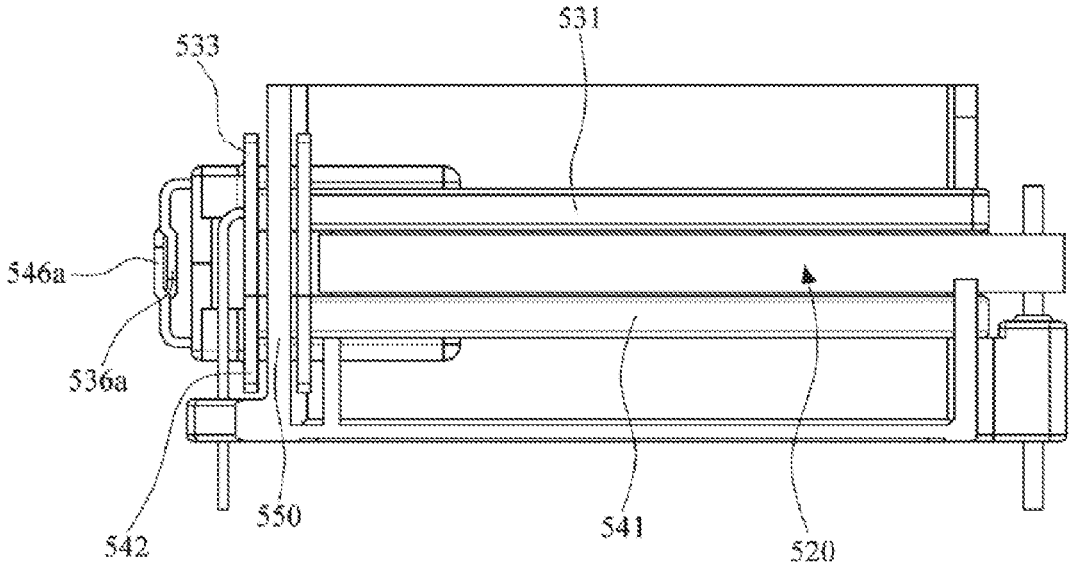
FIG. 22 is a side cross-sectional view of the transformer of FIG. 21.
Figure 23:
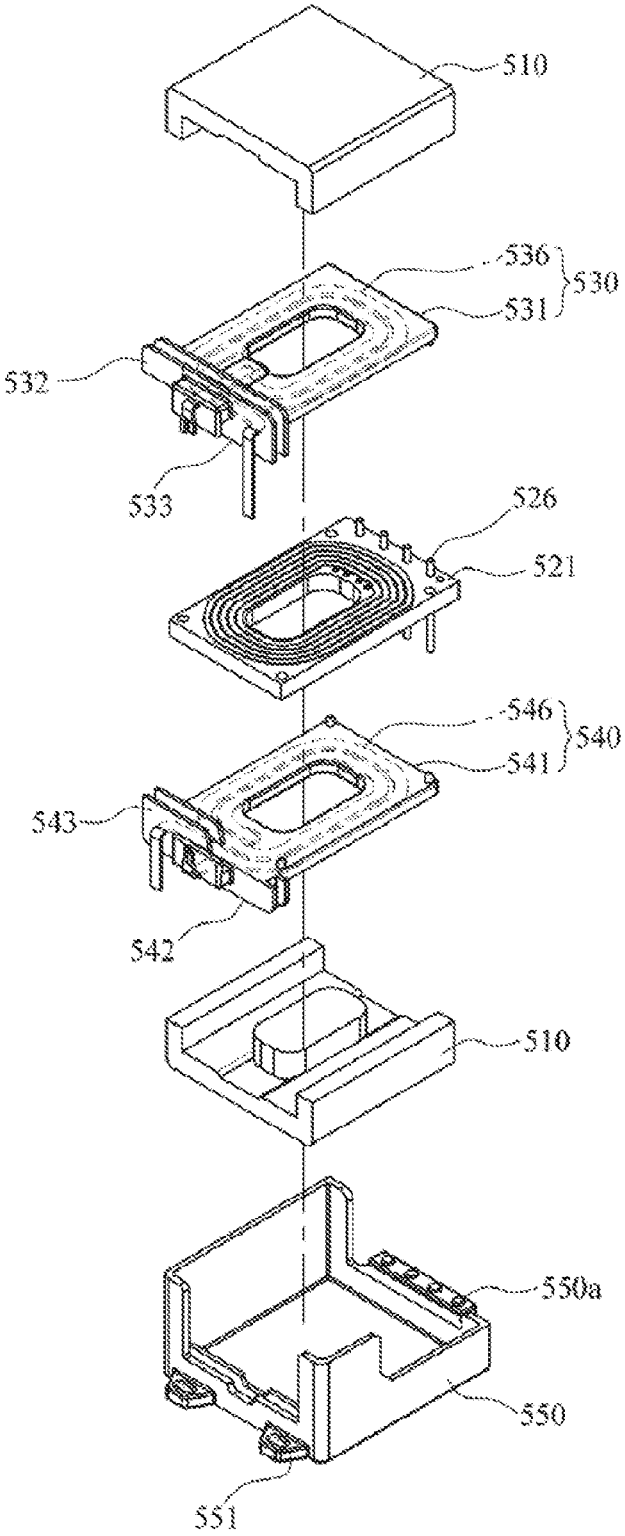
FIG. 23 is an exploded perspective view of the transformer of FIG. 21.
Figure 24:
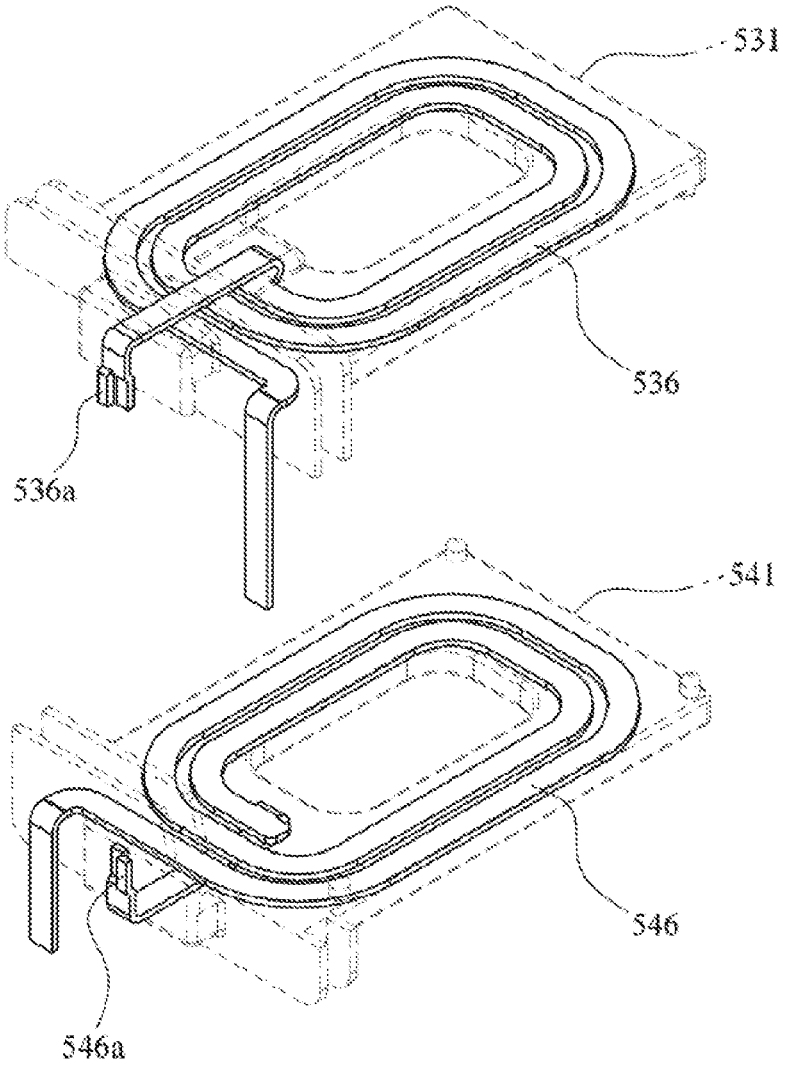
FIG. 24 is a perspective view of upper and lower secondary coil modules extracted from the transformer of FIG. 23.

FIG. 21 is a perspective view of a transformer according to a fifth embodiment of the present disclosure, and FIG. 22 is a side cross-sectional view of the transformer of FIG. 21. FIG. 23 is an exploded perspective view of the transformer of FIG. 21, and FIG. 24 is a perspective view of upper and lower secondary coil modules extracted from the transformer of FIG. 23.

Referring to FIGS. 21 to 24, a transformer 500 according to a fifth embodiment of the present disclosure includes a magnetic core 510, a primary coil module 520, an upper secondary coil module 530, and a lower secondary coil module 540. Here, the magnetic core 510 and the primary coil module 520 according to this embodiment may be constructed in the same manner as the magnetic core 110 and the primary coil module 120 according to the first embodiment.

In comparison to the upper and lower plate coils 436 and 446 according to the fourth embodiment, the upper and lower plate coils 536 and 546 according to this embodiment are different from the upper and lower plate coils 436 and 446 according to the fourth embodiment on the point that one of respective intermediate regions, which is connected to an outer end portion, is extended longer, and thus the outer end portion is oppositely positioned on the basis of an inner end portion.

In addition, the inner end portion of the upper plate coil 536 and the inner end portion of the lower plate coil 546 are respectively divided into two parts, and the divided regions 536*a* and 546*a* cross each other to be coupled to each other. Accordingly, it is easy that the inner end portion of the upper plate coil 536 and the inner end portion of the lower plate coil 546 are mechanically coupled to each other. The above-described coupled regions may be soldered. Of course, it is also possible that regions of the upper and lower plate coils 536 and 546 excluding the respective inner end portions are formed in the same manner as the upper and lower plate coils 436 and 446 according to the fourth embodiment.

On the other hand, the lower insulation molded body 541 may further include a first lower flange 542 and a second lower flange 543. The first lower flange 542 projects from the left, right, and lower sides of the circumference of a front surface of the lower insulation molded body 541, and a groove is formed along the projected surface. The second lower flange 543 projects from one side of an upper portion of the circumference of the front surface of the lower insulation molded body 541 and comes in contact with a lower surface of the upper insulation molded body 531.

The upper insulation molded body 531 may further include a first upper flange 532 and a second upper flange 533. The first upper flange 532 projects from the left, right, and upper sides of the circumference of a front surface of the upper insulation molded body 531, and a groove is formed along the projected surface.

The second upper flange 533 projects from the other side of a lower portion of the circumference of the front surface of the upper insulation molded body 531 and comes in contact with a side surface of the second lower flange 543. Accordingly, the upper and lower insulation molded bodies 531 and 541 may be aligned in up, down, left, and right directions by the second upper and lower flanges 533 and 543 to be supported. Grooves may be formed along the projected surfaces of the second upper and lower flanges 533 and 543.

A base member 550 accommodates the magnetic core 510 in the inner space thereof through an upper opening thereof. Around a front opening of the base member 550, left and right borders that are respectively inserted into left and right grooves of the first upper and lower flanges 532 and 542 and a lower border that is inserted into a lower groove of the first lower flange 542 are formed. Accordingly, the upper and lower insulation molded bodies 531 and 541 may be supported in a state where the upper and lower insulation molded bodies 531 and 541 are aligned by the base member 550.

The base member 550 may further include fixing rings 551 provided on the lower side of the front surface to insert and fix outer end portions of the upper and lower plate coils 536 and 546. Pin-fixing holes 550*a* for penetratingly fixing the outer lead pins 526 may be formed at the rear region of the base member 150.

Like the first embodiment, the upper insulation molded body 531 may be aligned with respect to the insulating substrate 521 by first alignment projections and first alignment grooves, and the lower insulation molded body 541 may be aligned with respect to the insulating substrate 521 by second alignment projections and second alignment grooves.

Figure 25:
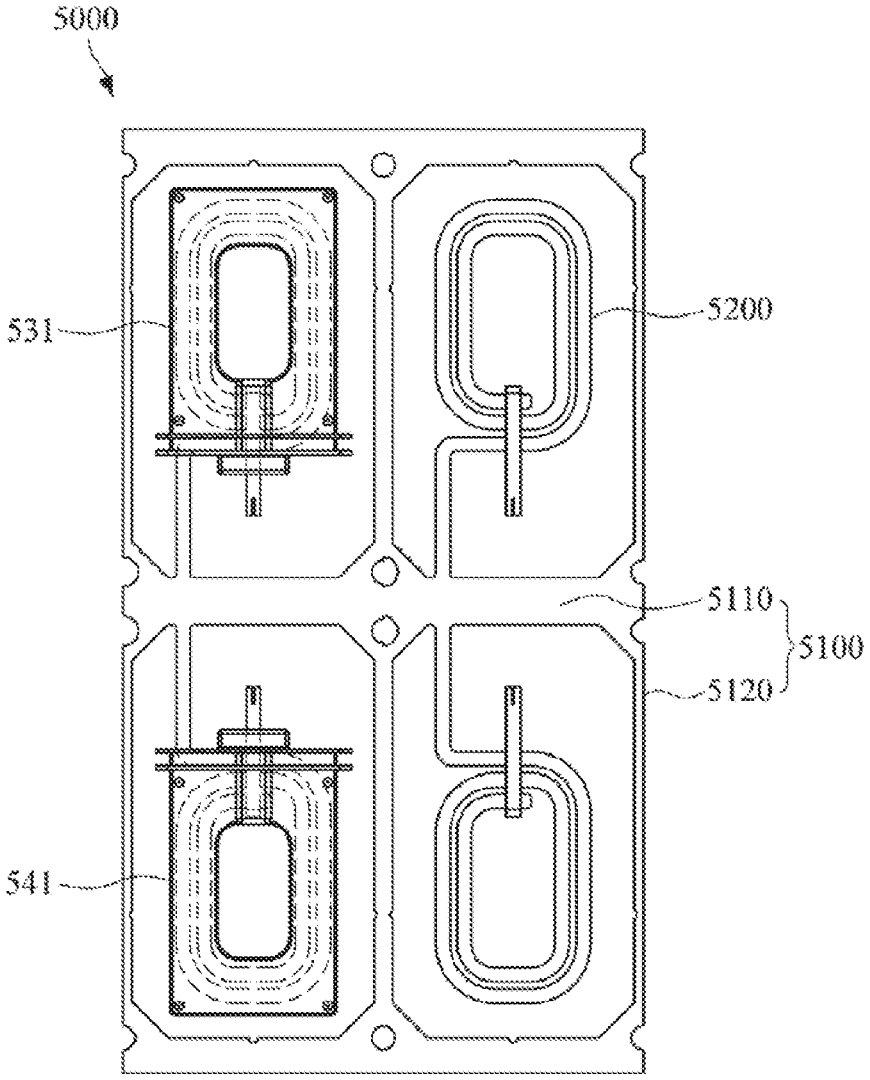
FIG. 25 is a plan view of a plate coil molded body used in upper and lower plate coils in FIG. 24.

On the other hand, the upper and lower plate coils 536 and 546 may be obtained through a sheet metal process and a bending process. For example, as illustrated in FIG. 25, through the sheet metal process and the bending process, a plate coil molded body 5000 is manufactured to include a frame 5100 and a plate coil 5200. The frame 5100 is formed to limit at least one accommodation space through connection of horizontal frames 5110 and vertical frames 5120.

The plate coil 5200 is formed to have an outer end portion connected to the horizontal frames 5110, an inner end portion arranged in parallel to the outer end portion, and an intermediate region wound in a spiral shape from the outer end portion and bent upward to be connected to the inner end portion in the accommodation space of the frame 5100.

A plurality of frames 5100 may be formed to limit arrangement of a plurality of accommodation spaces in horizontal and vertical directions. In addition, plate coils 5200 are formed to be accommodated in the accommodation spaces and to be arranged in the horizontal and vertical directions so that the plate coils 5200 are arranged in the same shape along the horizontal direction and are arranged symmetrically about a horizontal axis along the vertical direction. After the plate coil molded body 5000 is manufactured as described above, the plate coils 5200 may be separated from the frames 5100 to be used as the upper and lower plate coils 536 and 546.

Figure 26:
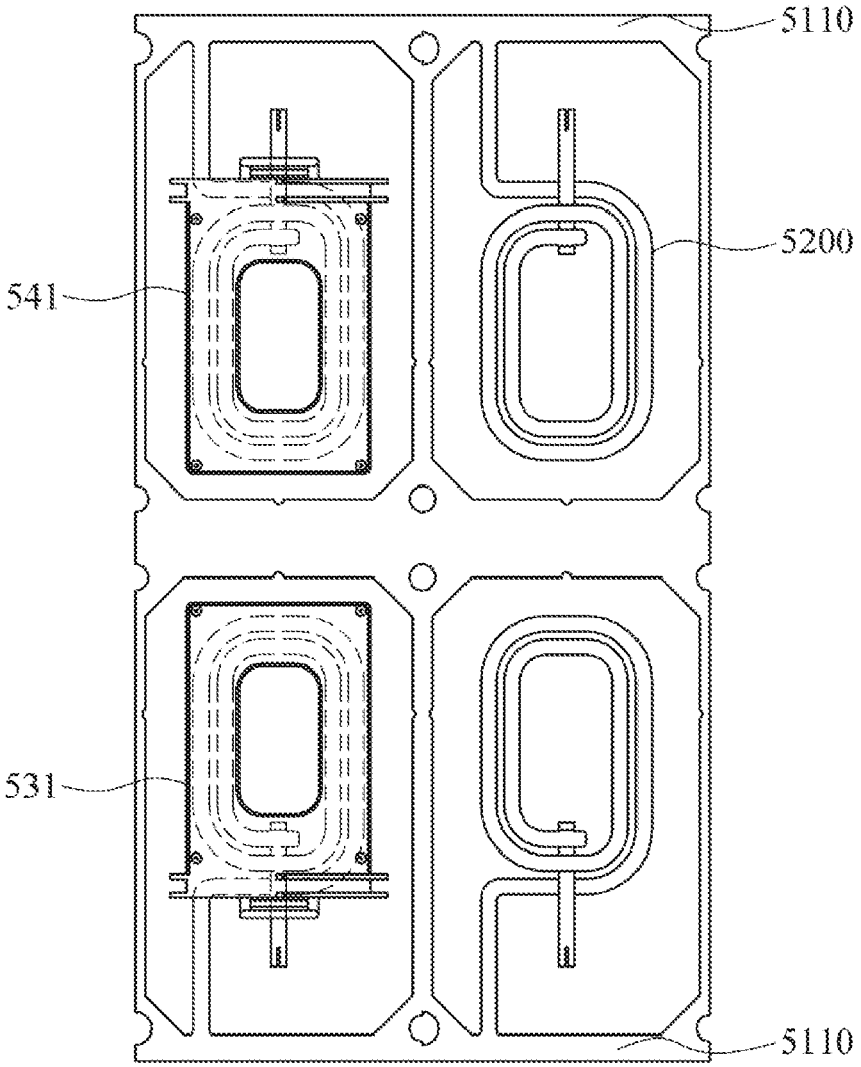
FIG. 26 is a plan view illustrating another example of the plate coil molded body of FIG. 25.

In the case where the frames 5100 limit the accommodation spaces two by two in the horizontal and vertical directions, respective outer end portions of the plate coils 5200 that are arranged along the vertical direction may be connected to the middle horizontal frames 5110. As another example, as illustrated in FIG. 26, the respective outer end portions of the plate coils 5200 that are arranged along the vertical direction may be connected to the outer horizontal frames 5110, respectively.

The upper and lower secondary coil modules 530 and 540 may be manufactured through insert injection molding. If the plate coil molded body 5000 is inserted into the injection mold, the upper insulation molded body 531 may be injection-molded in one of the two plate coils 5200 that are adjacent in the horizontal direction, and the lower insulation molded body 541 may be injection-molded in the other of the two plate coils 5200 to be separated from the frames 5100.

Sixth Embodiment

Figure 27:
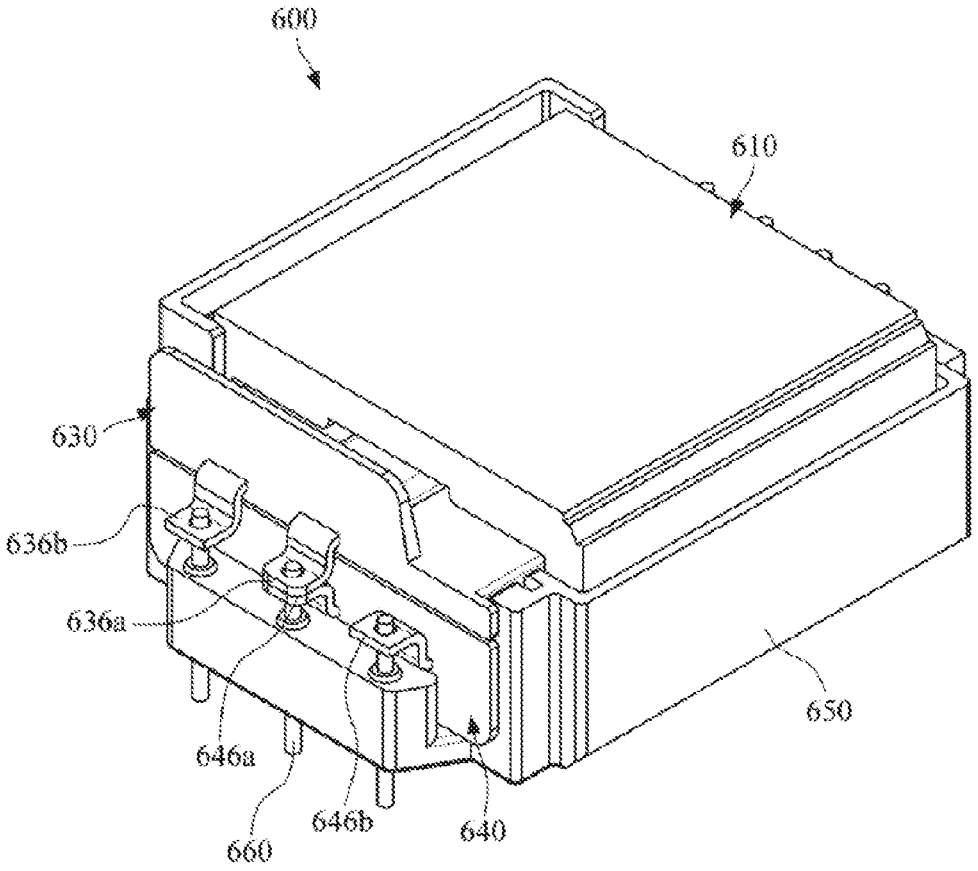
FIG. 27 is a perspective view of a transformer according to a sixth embodiment of the present disclosure.
Figure 28:
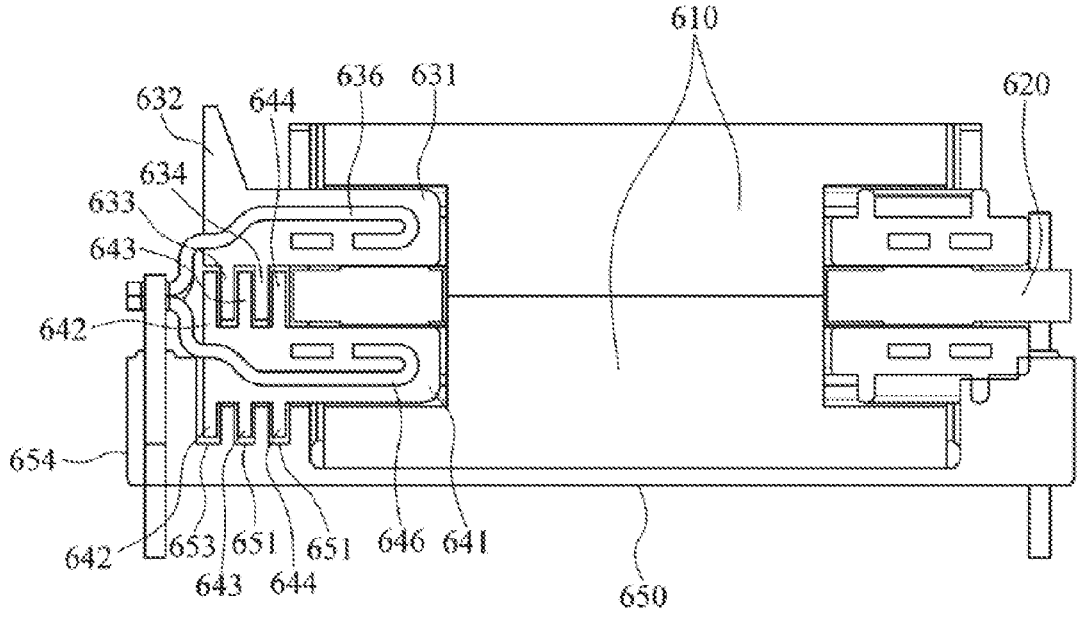
FIG. 28 is a side cross-sectional view of the transformer of FIG. 27.
Figure 29:
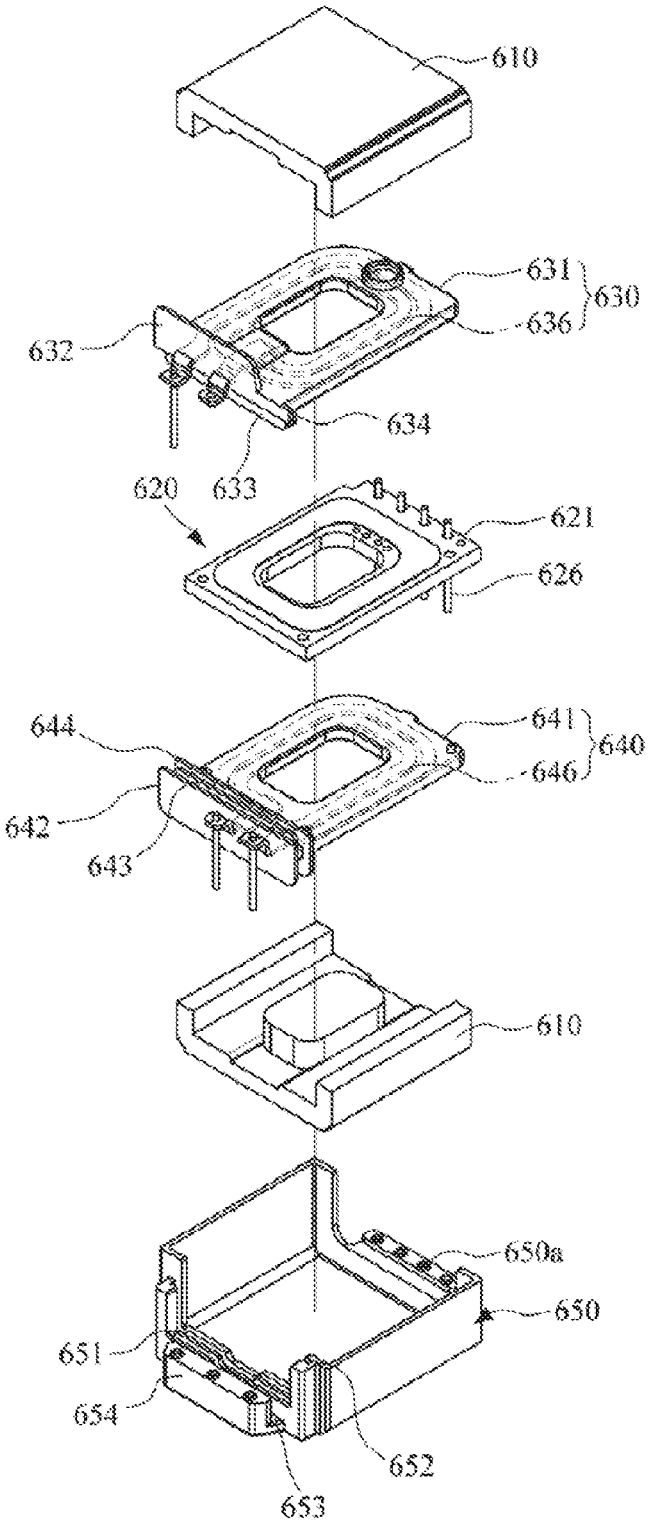
FIG. 29 is an exploded perspective view of the transformer of FIG. 27.
Figure 30:
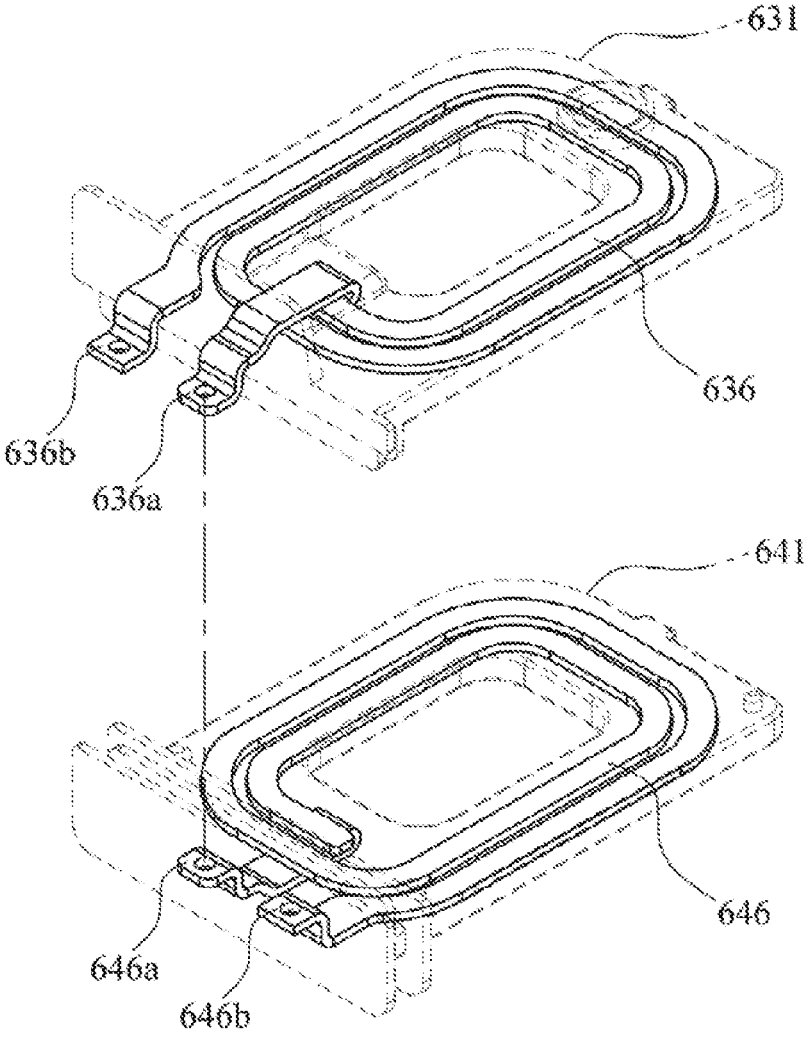
FIG. 30 is a perspective view of upper and lower secondary coil modules extracted from the transformer of FIG. 29.

FIG. 27 is a perspective view of a transformer according to a sixth embodiment of the present disclosure, and FIG. 28 is a side cross-sectional view of the transformer of FIG. 27. FIG. 29 is an exploded perspective view of the transformer of FIG. 27, and FIG. 30 is a perspective view of upper and lower secondary coil modules extracted from the transformer of FIG. 29.

Referring to FIGS. 27 to 30, a transformer 600 according to a sixth embodiment of the present disclosure includes a magnetic core 610, a primary coil module 620, an upper secondary coil module 630, and a lower secondary coil module 640. Here, the magnetic core 610 and the primary coil module 620 according to this embodiment may be constructed in the same manner as the magnetic core 110 and the primary coil module 120 according to the first embodiment.

In comparison to the upper and lower plate coils 436 and 446 according to the fourth embodiment, the upper and lower plate coils 636 and 646 according to this embodiment are different from the upper and lower plate coils 436 and 446 according to the fourth embodiment on the point that the inner end portion of the upper plate coil 636 includes an upper extension piece 636*a* that is extended downward with a step height, and the inner end portion of the lower plate coil 646 includes a lower extension piece 646*a* that is extended upward with a step height and comes in contact with the upper extension piece 636*a*. Further, on the upper and lower extension pieces 636*a* and 646*a*, coupling holes to which connection pins 660 are commonly insertion-coupled.

The upper extension piece 636*a* may be bent downward by 90° from the inner end portion of the upper plate coil 636 to be extended, and then may be bent upward by 90° to be extended. The lower extension piece 646*a* may be bent upward by 90° from the inner end portion of the lower plate coil 646 to be extended, and then may be bent downward by 90° to be extended.

The inner end portion of the upper plate coil 636, which is a region that is adjacent to the upper extension piece 636*a*, may be additionally extended downward with a step height. The inner end portion of the lower plate coil 646, which is a region that is adjacent to the lower extension piece 646*a*, may be additionally extended upward with a step height.

The outer end portion of the upper plate coil 636 may also include an upper extension piece 636*b* that is extended downward with a step height, and the outer end portion of the lower plate coil 646 may also include a lower extension piece 646*b* that is extended upward with a step height. Coupling holes, to which connection pins 660 are insertion-coupled, are formed on the upper and lower extension pieces 636*b* and 646*b* that are provided on the outer end portions of the upper and lower plate coils 636 and 646. The connection pins 660 are connected to an adaptor substrate.

On the other hand, the lower insulation molded body 641 may further include a lower flange 642, a first lower alignment rib 643, and a second lower alignment rib 644. The lower flange 642 projects along the circumference of a front surface of the lower insulation molded body 641.

The first lower alignment rib 643 projects from the lower flange 642 to the rear side to be spaced apart from the upper surface of the lower insulation molded body 641. The first lower alignment rib 643 may additionally project from the lower surface of the lower insulation molded body 641.

The second lower alignment rib 644 projects from the first lower alignment rib 643 to the rear side to be spaced apart from the upper surface of the lower insulation molded body 641. The second lower alignment rib 6434 may additionally project from the left, right, and lower surfaces of the lower insulation molded body 641.

The upper insulation molded body 631 may further include an upper flange 632, a first upper alignment rib 633, and a second upper alignment rib 634. The upper flange 632 is formed on a region of the front surface of the upper insulation molded body 631. The lower end region of the upper flange 632 may be arranged to face the upper end region of the lower flange 642. The upper flange 632 may be formed to project through the left, right, and partial upper surfaces of the upper insulation molded body 631.

The first upper alignment rib 633 is arranged from the upper flange 632 to the rear side to be spaced apart from the lower surface of the upper insulation molded body 631, and is fitted between the lower flange 642 and the first lower alignment rib 643.

The second upper alignment rib 634 projects from the first upper alignment rib 633 to the rear side to be spaced apart from the lower surface of the upper insulation molded body 631, and is fitted between the first lower alignment rib 643 and the second lower alignment rib 644. Accordingly, the upper insulation molded body 631 can be aligned with the lower alignment molded body 641 to be supported.

A base member 650 accommodates the magnetic core 610 in the inner space thereof through an upper opening thereof. The base member 650 has a front opening. The front opening of the base member 650 is formed to make the upper portion thereof in an open state. The base member 650 is formed so that the periphery of the front opening supports rear surfaces of the upper and lower flanges 632 and 642.

First support grooves 651 for inserting respective lower end regions of the first and second lower alignment ribs 643 and 644 into the lower surface of the front opening are formed on the base member 650. A second support groove 652 for inserting regions of the left and right sides of the second lower alignment rib 644 into the left and right side surfaces of the front opening is formed on the base member 650. Accordingly, the lower insulation molded body 641 can be aligned with the base member 650 to be supported.

The base member 650 may further include a support step portion 653 and a support block 654. The support step portion 653 projects from the lower side of the front surface of the base member 650 to support the lower end region of the lower flange 642. The support block 654 is formed to support the support step portion 653 through insertion of the connection pins 660 into the upper surface of the support step portion 653. The support block 654 has holes that penetrate the connection pins 660. The support block 654 can support the front surface of the lower flange 642. Pin-fixing holes 650*a* for penetratingly fixing the outer lead pins 626 may be formed at the rear region of the base member 150.

Like the first embodiment, the upper insulation molded body 631 may be aligned with respect to the insulating substrate 621 by first alignment projections and first alignment grooves, and the lower insulation molded body 641 may be aligned with respect to the insulating substrate 621 by second alignment projections and second alignment grooves.

Seventh Embodiment

Figure 31:
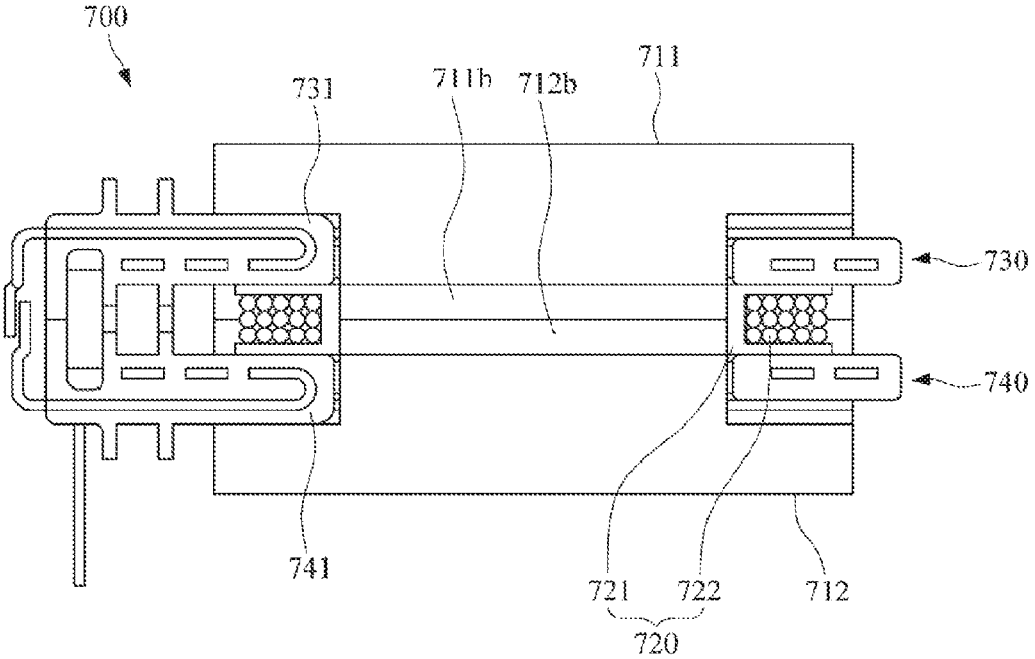
FIG. 31 is a side cross-sectional view of a transformer according to a seventh embodiment of the present disclosure.

FIG. 31 is a side cross-sectional view of a transformer according to a seventh embodiment of the present disclosure.

Referring to FIG. 31, a transformer 700 according to a seventh embodiment of the present disclosure includes a magnetic core 710, a primary coil module 720, an upper secondary coil module 730, and a lower secondary coil module 740. Here, the magnetic core 710 according to this embodiment may be constructed in various shapes like the magnetic core 110 or 310 according to the first or third embodiment.

Although it is exemplified that the upper and lower secondary coil modules 730 and 740 are the upper and lower secondary coil modules 530 and 540 according to the fifth embodiment, they can also be constructed in the same manner as the upper and lower secondary coil modules according to any one of the first to fourth embodiments and the sixth embodiment.

A coil support of the primary coil module 720 may be composed of a bobbin 721. A primary coil of the primary coil module may be composed of a piece of wire 722 that is wound on the bobbin 721. The primary coil may be composed of a Ritz wire that is formed by twisting several pieces of wires.

The bobbin 721 has through-holes for passing second legs 711*b* and 712*b* of upper and lower cores 711 and 712. The bobbin 721 may be connected to an upper surface of a lower insulation molded body 741. The through-holes of the bobbin 721 correspond to through-holes of the lower insulation molded body 741. The bobbin 721 may be integrally formed when the lower insulation molded body 741 is formed. As another example, the bobbin 721 may be integrally formed with a lower surface of an upper insulation molded body 731.

Eighth Embodiment

Figure 32:
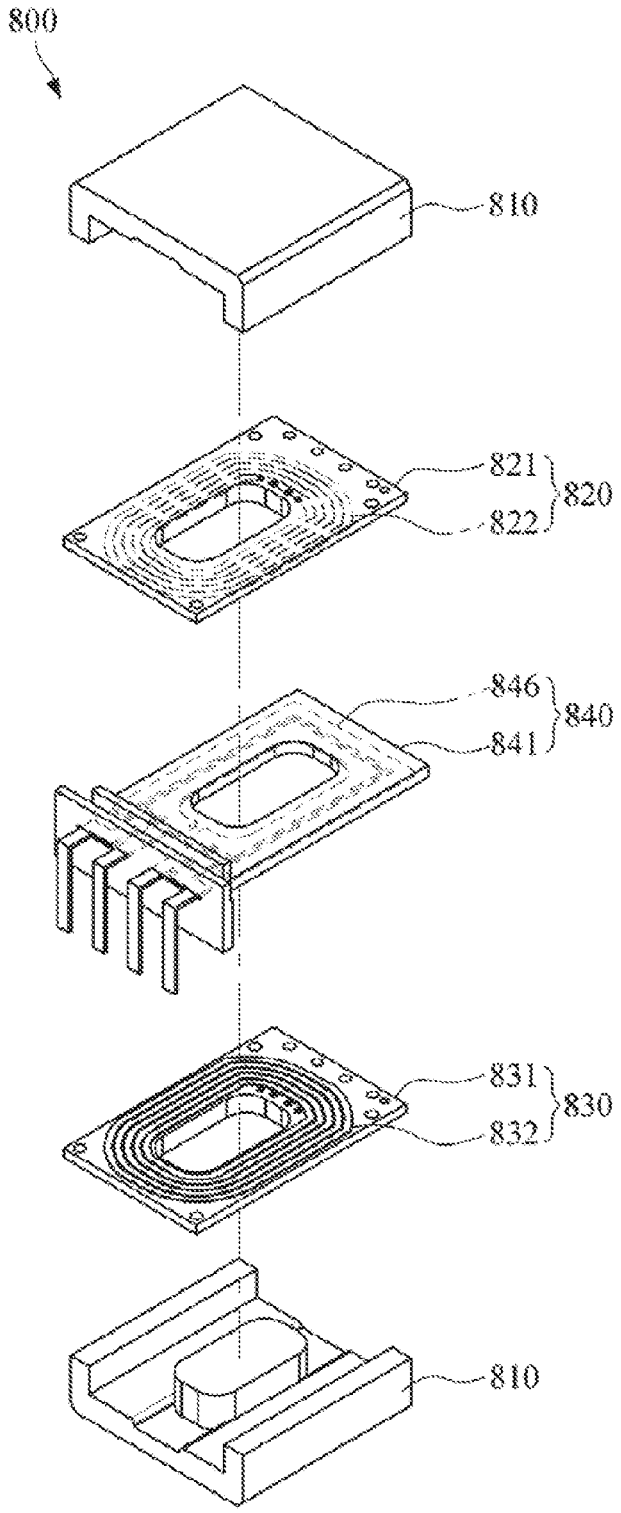
FIG. 32 is an exploded perspective view of a transformer according to an eighth embodiment of the present disclosure.

FIG. 32 is an exploded perspective view of a transformer according to an eighth embodiment of the present disclosure.

Referring to FIG. 32, a transformer 800 according to an eighth embodiment of the present disclosure includes a magnetic core 810, an upper primary coil module 820, a lower primary coil module 820, a lower primary coil module 830, and a secondary coil module 840. Here, the magnetic core 810 according to this embodiment may be constructed in various shapes like the magnetic core 110 or 310 according to the first or third embodiment.

The upper primary coil module 820 includes an upper insulating substrate 821 arranged in the magnetic core 810 and an upper conductor pattern 822 formed as at least one layer on the upper insulating substrate 821.

The upper and lower insulating substrates 821 and 831 are in a rectangular plate shape.

The upper and lower primary coil modules 820 and 830 may be obtained by dividing the primary coil module 120 according to the first embodiment into two modules. The upper primary coil module 820 may further include an auxiliary coil that generates and outputs an induced voltage through electromagnetic induction with the upper conductor pattern 822. The auxiliary coil may be included in the lower primary coil module 830.

Although not illustrated, as another example, the upper and lower primary coil modules 820 and 830 may be constructed in a state where wires are wound on bobbins. The bobbins may be connected to upper and lower surfaces of an insulation molded body 841 of the secondary coil module 840. The bobbins may be integrally formed when the insulation molded body 841 is formed.

The secondary coil module 840 includes an insulation molded body 841 and a plate coil 846. The insulation molded body 841 is arranged in the magnetic core 810 in a state where the insulation molded body 841 is inserted between the upper insulating substrate 821 and the lower insulating substrate 831. The plate coil 846 is buried in the insulation molded body 841 in a state where end portions thereof are exposed, and is arranged to face the upper and lower conductor patterns 822 and 832.

Although the plate coil 846 is exemplified in the same manner as the upper plate coil 136 or the lower plate coil 146 according to the first embodiment, it may also be constructed in the same manner as the upper plate coil or the lower plate coil according to any one of the second to sixth embodiments. The secondary coil module 840 can be arranged on the upper side of the upper primary coil module 820 or the lower side of the upper or lower primary coil module 830, but is not limited thereto.

Ninth Embodiment

Figure 33:
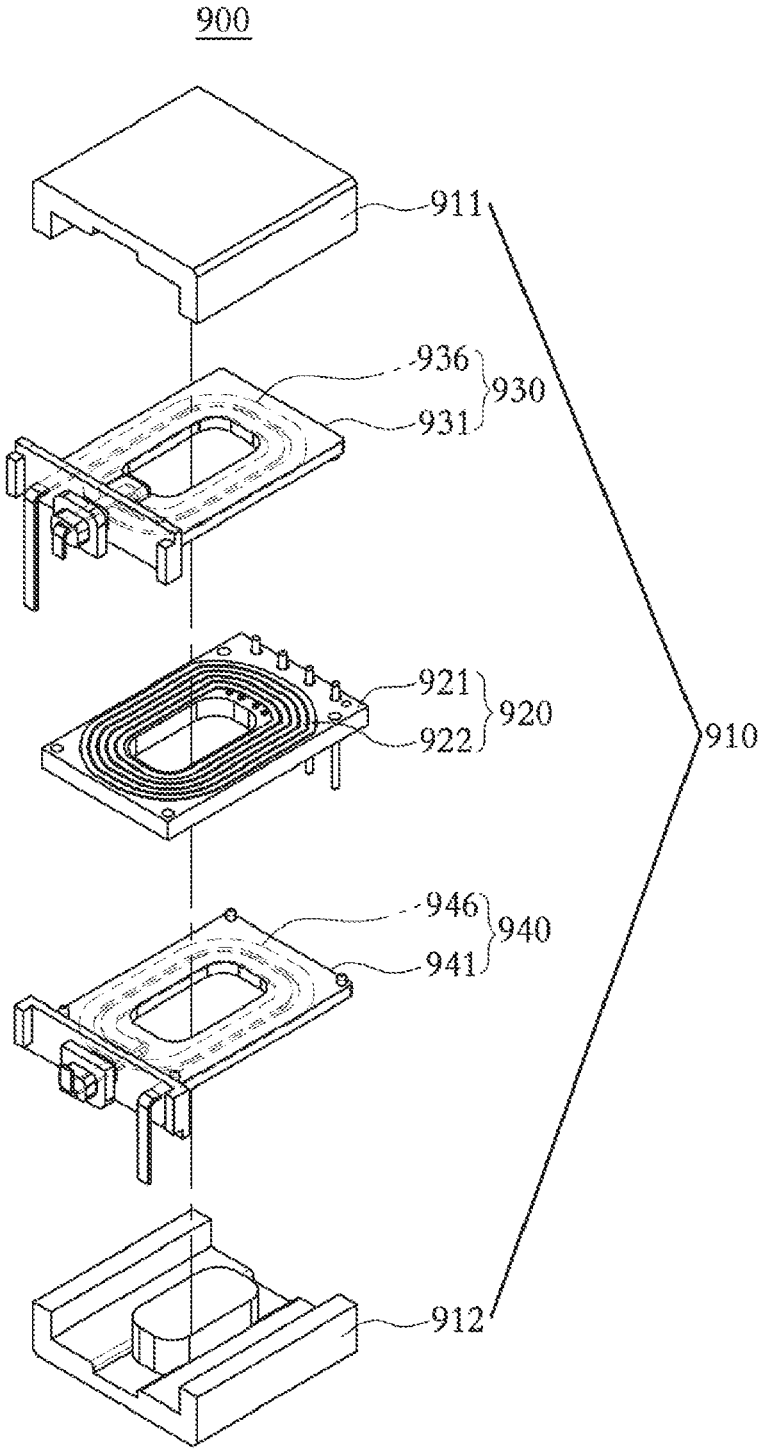
FIG. 33 is an exploded perspective view of a transformer according to a ninth embodiment of the present disclosure.

FIG. 33 is an exploded perspective view of a transformer according to a ninth embodiment of the present disclosure.

Referring to FIG. 33, a transformer 900 according to a ninth embodiment of the present disclosure includes a magnetic core 910, a primary coil module 920, an upper secondary coil module 930, and a lower secondary coil module 940.

The magnetic core 910 is formed to have an inner space, and front and rear sides of the magnetic core 910 are formed in an open shape. Since the detailed construction of the magnetic core 910 is the same as that of the magnetic core 110 according to the first embodiment, the duplicate explanation thereof will be omitted.

The primary coil module 920 includes a coil support arranged in the magnetic core 910 and a primary coil formed on the coil support. Since the detailed function and shape of the primary coil module 920 are the same as those of the primary coil module 120 according to the first embodiment, the duplicate explanation thereof will be omitted.

The upper secondary coil module 930 includes an upper insulation molded body 931 and an upper plate coil 936.

The upper insulation molded body 931 may be arranged in the magnetic core 910 to come in contact with the upper side of the insulating substrate 921. Further, the upper insulation molded body 931 insulates the upper plate coil 936 from the primary coil module 920 and the upper core 911 through regions that cover the upper and lower portions of the upper plate coil 936. The upper insulation molded body 931 as described above may be implemented by an insulation material such as liquid crystal polymer (LCP).

Accordingly, an insulation distance may be secured between the upper plate coil 936 and the primary coil module 920, and an insulation distance may be secured between the upper plate coil 936 and the upper core 911.

The upper insulation molded body 931 has through-holes formed in the center thereof to pass second leg of the upper core 911 therethrough. The upper insulation molded body 931 may be formed in a rectangular plate shape, and may come in surface contact with the primary coil module 920 and the upper core 911.

The upper plate coil 936 is buried in the upper insulation molded body 931 in a state where end portions thereof are exposed. The upper plate coil 936 is arranged to face the primary coil module 920 and a conductor pattern 922 in a surface-to-surface manner. The upper plate coil 936 generates an induced voltage through electromagnetic induction with the conductor pattern 922.

The upper plate coil 936 is formed on the upper insulation molded body 931. Specifically, the upper plate coil 936 may be implemented by one upper plate member or a plurality of upper plate members.

First, in the case where the upper plate coil 936 is implemented by one upper plate member, both end portions of the upper plate coil 936 may be drawn to the front surface of the upper insulation molded body 931, and an intermediate region thereof may be wound in the circumferential direction of the upper insulation molded body 931. Further, one end portion of the upper plate coil 936 may be drawn to the front surface of the upper insulation molded body 931, an intermediate region thereof may be wound in a spiral shape to be buried in the upper insulation molded body 931, and the other end portion thereof may be bent in a lower direction to be drawn to the upper insulation molded body 931. In this case, the other end portion thereof may be drawn from the spiral-shaped inside to the lower portion of the upper insulation molded body 931, and may be drawn to the front surface of the upper insulation molded body 931 in a state where it is bent plural times in the upper insulation molded body 931 to be additionally bent downward. In this case, the winding ratio of the primary coil to the upper plate member may be 36:4 or 36:2.

In the case where the upper plate coil 936 is implemented by two upper plate members, like the first embodiment, the upper plate member 936 may include a first upper plate coil member having both end portions that are drawn to the front surface of the upper insulation molded body 931 and an intermediate region that is wound in the circumferential direction of the upper insulation molded body to be buried in the upper insulation molded body 931, and a second upper plate coil member having both end portions that are drawn from the front surface of the upper insulation molded body 931 and between the both end portions of the first upper plate coil member and an intermediate region that is wound from the inside of the first upper plate coil member to be spaced apart from the first upper plate coil member and is buried in the upper insulation molded body 931. In the illustrated example, it is exemplified that two upper plate members are used. However, during implementation, the upper plate coil may be implemented using three or more upper plate members.

The lower secondary coil module 940 includes a lower insulation molded body 941 and a lower plate coil 946. The lower insulation molded body 941 is arranged in the magnetic core 910 to come in contact with the lower side of the insulating substrate 921.

The lower insulation molded body 941 insulates the lower plate coil 946 from the primary coil module 920 and the lower core 912 through regions that cover the upper and lower portions of the lower plate coil 946. The lower insulation molded body 941 may be implemented by an insulation material such as liquid crystal polymer (LCP).

Accordingly, the insulation distance may be secured between the lower plate coil 946 and the primary coil module 920, and the insulation distance may be secured between the lower plate coil 946 and the lower core 912. The lower insulation molded body 941 has through-holes formed in the center thereof to penetrate the second leg of the lower core 912. The lower insulation molded body 941 may be in a rectangular plate shape, and may come in contact with the primary coil module 920 and the lower core 912.

The lower plate coil 946 is buried in the lower insulation molded body 941 in a state where end portions of the lower plate coil 946 are exposed. The lower plate coil 946 is arranged to face the conductor pattern 922 of the primary coil module 920 in a surface-to-surface manner. The lower plate coil 946 generates an induced voltage through electromagnetic induction with the conductor pattern 922. The lower plate coil 946 may be connected to the upper plate coil 936 by wire.

The lower plate coil 946 is formed on the lower insulation molded body 941. Specifically, the lower plate coil 946 may be implemented by one lower plate member or a plurality of lower plate members.

First, in the case where the lower plate coil 946 is implemented by one lower plate member, both end portions of the lower plate coil 946 may be drawn to the front surface of the lower insulation molded body 941, and an intermediate region thereof may be wound in the circumferential direction of the lower insulation molded body 941.

Further, one end portion of the lower plate coil 946 may be drawn to the front surface of the lower insulation molded body 941, an intermediate region thereof may be wound in a spiral shape to be buried in the lower insulation molded body 941, and the other end portion thereof may be bent in a lower direction to be drawn to the lower insulation molded body 941. In this case, the other end portion thereof may be drawn from the spiral-shaped inside to the lower portion of the lower insulation molded body 941, and may be drawn to the front surface of the lower insulation molded body 941 in a state where it is bent plural times in the lower insulation molded body 941 to be additionally bent upward. Further, the spiral direction of the lower plate member may be the same as the spiral direction of the upper plate member or may be an opposite direction thereof. In this case, the winding ratio of the primary coil to the lower plate member may be 36:4 or 36:2.

In the case where the lower plate coil is implemented by two lower plate members, like the first embodiment, the lower plate member 946 may include a first lower plate coil member having both end portions that are drawn to the front surface of the lower insulation molded body 941 and an intermediate region that is wound in the circumferential direction of the lower insulation molded body to be buried in the upper insulation molded body 941, and a second lower plate coil member having both end portions that are drawn from the front surface of the lower insulation molded body 941 and between the both end portions of the first lower plate coil member and an intermediate region that is wound from the inside of the first lower plate coil member to be spaced apart from the first lower plate coil member and is buried in the lower insulation molded body 941. In the illustrated example, it is exemplified that two lower plate members are used. However, during implementation, the lower plate coil may be implemented using three or more lower plate members.

As described above, since the upper and lower plate coils 936 and 946 are in a plate shape and face the conductor pattern 922 of the primary coil module 920, the coupling coefficient between the upper and lower plate coils 936 and 946 and the conductor pattern 922 of the primary coil module 920 can be heightened. Since the upper and lower secondary coil modules 930 and 940 are arranged on the upper and lower sides in a state where the primary coil module 920 is interposed between the upper and lower secondary coil modules 930 and 940, the upper and lower plate coils 936 and 946 can be arranged maximally close to the conductor pattern 922. Accordingly, leakage inductance can be reduced.

Further, since the upper and lower insulation molded bodies 931 and 941 are formed to bury the upper and lower plate coils 936 and 946 that are plate-shaped therein, the assembly procedures can be reduced in comparison to a case where the upper and lower plate coils 936 and 946 are assembled to the insulation member. Further, since the thickness of the upper and lower insulation molded bodies 931 and 941 becomes thin, the transformer 900 can be miniaturized with a reduced height. Accordingly, an air flow for cooling can be formed inside an adaptor to the extent of the reduced height of the transformer 900 in a state where the transformer 900 is mounted in the adaptor to cause the temperature of the adaptor to be reduced.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A transformer comprising:

a magnetic core;

a primary coil module including a coil support arranged in the magnetic core and a primary coil formed on the coil support;

an upper secondary coil module including an upper insulation molded body arranged on an upper portion of the primary coil module and an upper plate coil buried in the upper insulation molded body such that only a terminal part of the upper plate coil is exposed, and arranged to face the primary coil; and a lower secondary coil module including a lower insulation molded body arranged on a lower portion of the primary coil module and a lower plate coil buried in the lower insulation molded body such that only a terminal part of the lower plate coil is exposed, and arranged to face the primary coil, wherein the upper insulation molded body includes an upper flange arranged on a front surface of the upper insulation molded body, wherein the lower insulation molded body includes a lower flange arranged on a front surface of the lower insulation molded body, wherein a lower surface of the upper flange and an upper surface of the lower flange mutually match each other, wherein the upper plate coil includes:

a first upper plate coil member having both end portions drawn from the front surface of the upper insulation molded body and an intermediate region wound in a circumferential direction of the upper insulation molded body and buried in the upper insulation molded body; and a second upper plate coil member having both end portions drawn from the front surface of the upper insulation molded body and disposed between the both end portions of the first upper plate coil member and an intermediate region wound to be spaced apart from an inside of the first upper plate coil member and buried in the upper insulation molded body, the intermediate region of the second upper plate coil member and the intermediate region of the first upper plate coil member being positioned on a same plane, and wherein the lower plate coil includes:

a first lower plate coil member having both end portions drawn from the front surface of the lower insulation molded body and an intermediate region wound in a circumferential direction of the lower insulation molded body and buried in the lower insulation molded body; and a second lower plate coil member having both end portions drawn from the front surface of the lower insulation molded body and disposed between the both end portions of the first lower plate coil member and an intermediate region wound to be spaced apart from an inside of the first lower plate coil member and buried in the lower insulation molded body, the intermediate region of the second lower plate coil member and the intermediate region of the first lower plate coil member being positioned on a same plane.

2. The transformer as claimed in claim 1, wherein one end portion of the first upper plate coil member and one end portion of the second lower plate coil member are connected by wire, one end portion of the first lower plate coil member and one end portion of the second upper plate coil member are connected by wire, and the other end portion of the second upper plate coil member and the other end portion of the second lower plate coil member are connected by wire.

3. The transformer as claimed in claim 1, wherein the upper plate coil includes one end portion drawn from a front surface of the upper insulation molded body, an intermediate region wound in a spiral shape and buried in the upper insulation molded body, and the other end portion bent in a lower direction and drawn to the upper insulation molded body, and the lower plate coil includes one end portion drawn from a front surface of the lower insulation molded body, an intermediate region wound in a spiral shape and buried in the lower insulation molded body, and the other end portion bent in an upper direction and drawn from the lower insulation molded body.

4. The transformer as claimed in claim 3, wherein a spiral direction of the upper plate coil is opposite to a spiral direction of the lower plate coil.

5. The transformer as claimed in claim 3, wherein a spiral direction of the upper plate coil is the same as a spiral direction of the lower plate coil.

6. The transformer as claimed in claim 3, wherein one end portion of the upper plate coil is bent to project from an outside of the upper insulation molded body to a lower side, and one end portion of the lower plate coil is bent to project from an outside of the lower insulation molded body to a lower side.

7. The transformer as claimed in claim 6, wherein the other end portion of the upper plate coil and the other end portion of the lower plate coil are respectively drawn from the upper insulation molded body and the lower insulation molded body and bent to face each other to be connected to each other by wire.

8. The transformer as claimed in claim 6, wherein the other end portion of the upper plate coil and the other end portion of the lower plate coil have cut grooves formed thereon.

9. The transformer as claimed in claim 6, wherein an end of the other end portion of the upper plate coil has at least one of a groove and a projection formed thereon, and an end of the other end portion of the lower plate coil has at least one of a projection and a groove that can be coupled to the end of the other end portion of the upper plate coil.

10. The transformer as claimed in claim 7, wherein the other end portion of the upper plate coil and the other end portion of the lower plate coil are connected by wire in a spiral of the upper plate coil and a spiral of the lower plate coil.

11. The transformer as claimed in claim 7, wherein the other end portion of the upper plate coil and the other end portion of the lower plate coil are bent plural times, and are connected by wire on front surfaces of the upper insulation molded body and the lower insulation molded body.

12. The transformer as claimed claim 11, wherein the other end portion of the upper plate coil and the other end portion of the lower plate coil are connected by wire through soldering.

13. The transformer as claimed in claim 1, wherein the upper plate coil includes one end portion drawn from a front surface of the upper insulation molded body, an intermediate region wound in a spiral shape and buried in the upper insulation molded body, and the other end portion drawn to the upper insulation molded body through an upper side of the intermediate region, and the lower plate coil includes one end portion drawn from a front surface of the lower insulation molded body, an intermediate region wound in a spiral shape and buried in the lower insulation molded body, and the other end portion drawn to the lower insulation molded body through a lower side of the intermediate region.

14. The transformer as claimed in claim 1, wherein the lower insulation molded body further comprises at least one lower alignment rib projecting from the lower flange to a rear side in an upper direction to be spaced apart from the lower flange.

15. The transformer as claimed in claim 1, wherein the upper insulation molded body further comprises at least one upper alignment rib projecting from the upper flange to a rear side to be spaced apart from the upper flange.

16. The transformer as claimed in claim 1, wherein the lower insulation molded body includes a first lower rib projecting from left, right, and upper sides of a circumference of a front surface, a pair of second lower ribs projecting from a lower side of the circumference of the front surface to be spaced apart from each other and bent toward a center of a front side to be extended, and a lower extension block extended to the front side of the front surface, and the upper insulation molded body includes a first upper rib projecting from left, right, and lower sides of the circumference of the front surface, a pair of second upper ribs projecting from an upper side of the circumference of the front surface to be spaced apart from each other and bent toward the center of the front side to be extended, and an upper extension block extended to the front side of the front surface.

17. The transformer as claimed in claim 1, further comprising a base member accommodating the magnetic core in an inner space of the base member and having a side wall formed thereon.

18. The transformer as claimed in claim 17, wherein the base member further comprises fixing rings for inserting and fixing an outer end portions of the upper and lower plate coils.

19. The transformer as claimed in claim 17, wherein the base member is coupled to a lower end region of a lower flange arranged on a front surface of the lower insulation molded body or at least one lower alignment rib projecting in an upper direction to be spaced apart from the lower flange to a rear side.

20. The transformer as claimed in claim 1, wherein the lower insulation molded body includes a first lower flange projecting from left, right, and lower sides of a circumference of a front surface and having a groove formed along a projected surface and a second lower flange projecting from one side of an upper portion of the circumference of the front surface and coming in contact with a lower surface of the upper insulation molded body, the upper insulation molded body includes a first upper flange projecting from left, right, and upper sides of the circumference of the front surface and having a groove formed along a projected surface and a second upper flange projecting from the other side of a lower portion of the circumference of the front surface and coming in contact with an upper surface of the lower insulation molded body and a side surface of the second lower flange, and the transformer further comprises a base member configured to accommodate the magnetic core in an inner space through an upper opening and having left and right borders formed around a front opening to be inserted into left and right grooves of the first upper and lower flanges and a lower border inserted into a lower groove of the first lower flange.

21. The transformer as claimed in claim 1, wherein the magnetic core comprises an upper core and a lower core in which a pair of first legs project from left and right edges and a second leg projects from a center so that the magnetic core is penetratingly coupled to the primary coil module, the upper secondary coil module, and the lower secondary coil module.

22. The transformer as claimed in claim 21, wherein through-holes are formed on the upper insulation molded body and the lower insulation molded body, and the second leg penetrates the through-holes.

23. The transformer as claimed in claim 1, wherein the coil support is composed of an insulating substrate, and the primary coil is formed as at least one layer on the insulating substrate.

24. The transformer as claimed in claim 1, wherein the coil support is composed of a bobbin, and the primary coil is composed of a wire that is wound on the bobbin.

25. The transformer as claimed in claim 1, wherein an alignment projection is formed on any one of the coil support and the upper insulation molded body and an alignment groove that corresponds to the alignment projection is formed on the other thereof.

26. The transformer as claimed in claim 1, wherein an alignment projection is formed on any one of the coil support and the lower insulation molded body and an alignment groove that corresponds to the alignment projection is formed on the other thereof.

* * * * *